US006819311B2

(12) United States Patent
Nose et al.

(10) Patent No.: US 6,819,311 B2
(45) Date of Patent: Nov. 16, 2004

(54) DRIVING PROCESS FOR LIQUID CRYSTAL DISPLAY

(75) Inventors: Takashi Nose, Tokyo (JP); Hiroshi Hayama, Tokyo (JP)

(73) Assignee: NEC Corporation, Tokyo (JP)

( * ) Notice: Subject to any disclaimer, the term of this patent is extended or adjusted under 35 U.S.C. 154(b) by 345 days.

(21) Appl. No.: 09/730,610

(22) Filed: Dec. 7, 2000

(65) Prior Publication Data

US 2001/0003448 A1 Jun. 14, 2001

(30) Foreign Application Priority Data

Dec. 10, 1999 (JP) ..... 11-352355

(51) Int. Cl.[7] ..... G09G 3/36; G09G 5/00

(52) U.S. Cl. ..... 345/100; 345/94; 345/96; 345/99; 345/87; 345/214

(58) Field of Search ..... 345/87, 90, 89, 345/94–96, 98–99, 209, 214

(56) References Cited

U.S. PATENT DOCUMENTS

| | | | | |
|---|---|---|---|---|
| 6,320,562 | B1 * | 11/2001 | Ueno et al. | 345/87 |
| 6,373,456 | B1 * | 4/2002 | Matsubara | 345/94 |
| 6,392,620 | B1 * | 5/2002 | Mizutani et al. | 345/88 |
| 6,473,077 | B1 * | 10/2002 | Takenaka et al. | 345/209 |

FOREIGN PATENT DOCUMENTS

| | | |
|---|---|---|
| JP | 4-204628 | 7/1992 |
| JP | 4-309995 | 11/1992 |
| JP | 09-127917 | 5/1997 |
| JP | 10-062811 | 3/1998 |
| JP | 10-083169 | 3/1998 |
| JP | 11-030789 | 2/1999 |
| JP | 2000-122596 | 4/2000 |

OTHER PUBLICATIONS

"Degradation of Quality of Moving Images Displayed on Hold Type Displays and Its Improving Method" by Taiichiro Kurita, NHK Science and Technical Research Laboratories, 1999 Conference of the Electronic Information Communication Society, SC–8–1, pp. 207–208.

Japanese Office Action dated Apr. 23, 2002, with partial English translation.

* cited by examiner

*Primary Examiner*—Regina Liang
*Assistant Examiner*—Duc Q Dinh
(74) *Attorney, Agent, or Firm*—McGinn & Gibb, PLLC

(57) ABSTRACT

The provision of a liquid crystal display driving process which prevents the appearance of motion blur without any increase in circuit size or any reduction in panel numerical aperture. A driving process for a liquid crystal display in which a plurality of scanning lines 2 and a plurality of signal lines 3 are disposed in a grid like arrangement, and display of an image corresponding with image data is performed by selecting any one of the scanning lines 2 at one time, and altering the state of a liquid crystal via the signal line 3, wherein an image data selection period t1 and a black display selection period t2 are set within a time frame shorter than the time necessary for scanning any one of the aforementioned scanning lines 2, and an image corresponding with the aforementioned image data is displayed via the aforementioned signal line 3 during the image data selection period t1, and a monochromatic image is displayed via the aforementioned signal line 3 during the black display selection period t2.

22 Claims, 18 Drawing Sheets

DRIVING PROCESS FOR LIQUID CRYSTAL DISPLAY

BACKGROUND OF THE INVENTION

1. Field of the Invention

The present invention relates to a driving process for a liquid crystal display, and in particular to a driving process for an active matrix type liquid crystal display which is suitable for motion picture display.

2. Background Art

In recent years, liquid crystal displays (hereafter abbreviated as LCD) have increased in size and definition, and the range of images displayed is also widening, from the handling of mainly still images such as in the liquid crystal displays used with personal computers and word processors and the like, to incorporate the handling of motion pictures such as in the liquid crystal displays used as televisions and the like. An LCD is thinner than a TV equipped with a CRT (cathode ray tube), and can be installed without occupying much space, and consequently it is expected that LCDs will become widely used in average households.

FIG. 20 shows a sample construction of a conventional active matrix type LCD. The LCD comprises a first and a second glass substrate, and a liquid crystal display panel section 100 for displaying images. A number n (where n is a natural number) of scanning lines 101 and a number m (where m is also a natural number) of signal lines 102 are disposed in a grid like arrangement on top of the first glass substrate, and a TFT (thin film transistor) 103 which functions as a non linear element (switching element) is provided in the vicinity of each point of intersection between the scanning lines 101 and the signal lines 102.

A gate electrode of the TFT 103 is connected to the scanning line 101, a source electrode is connected to the signal line 102, and a drain electrode is connected to a pixel electrode 104. The aforementioned second glass substrate is then arranged in a position facing the first glass substrate, and a common electrode 105 is then formed on one surface of the glass substrate with a transference electrode of ITO or the like. Then, a liquid crystal is used to fill the space between the common electrode 105 and the pixel electrode 104 formed on the top of the first glass substrate.

The scanning lines 101 and the signal lines 102 are connected to a scanning line driving circuit 106 and a signal line driving circuit 107 respectively. The scanning line driving circuit 106 sequentially drives a large electric potential to the n scanning lines 101, and switches the TFT 103 connected to each scanning line 101 to an ON state. With the scanning line driving circuit 106 in the scanning state, the signal line driving circuit 107 outputs a gradation voltage corresponding with the image data to one of the m signal lines, and the gradation voltage is written to the pixel electrode 104 via the TFT 103 in an ON state, and the potential difference between the common electrode 105 which is set at a uniform potential, and the gradation voltage written to the pixel electrode 104 is used to control the amount of light transmission and consequently the display. The liquid crystal display panel section 100 is driven in this manner.

FIG. 21 is a diagram showing waveforms of signals output from the scanning line driving circuit 106 and the signal line driving circuit 107 of a conventional liquid crystal display to the scanning lines 101 and the signal lines 102 respectively. In FIG. 21, the symbols VG1 to VGn represent scanning signal waveforms applied to each of the scanning lines 101. As shown in the figure, the scanning signals VG1 to VGn apply a high electric potential to only one scanning line 101 at any one time, and the signals are output sequentially to the n scanning lines 101. Furthermore, the symbol VD represents a signal output to a single signal line 102, and the symbol Vcom represents a signal waveform applied to the common electrode 105. In the example shown in FIG. 21, the signal VD is a signal in which the signal strength varies in accordance with each piece of image data, whereas the signal Vcom is of a uniform value and does not vary over time.

Furthermore, in such a liquid crystal display, in order to prevent the deterioration of the liquid crystal, so-called AC driving is used, and generally the device is controlled so that a DC component voltage is never applied to the liquid crystal for a long period of time. One example of an AC drive method involves making the voltage applied to the common electrode 105 uniform, and applying alternate positive polarity and negative polarity signal voltages to the pixel electrode 104.

If motion picture display is conducted on this type of LCD, then problems of image quality deterioration, such as the residual image phenomenon, will arise. The cause of this problem is that because the response speed of the liquid crystal material is slow, when a gradation variation occurs, the liquid crystal is unable to track the gradation variation within a single field period and produces a cumulative response using several field periods. Consequently, considerable research is being conducted into various high speed response liquid crystal materials as a way of overcoming this problem.

However, the aforementioned problems such as the residual image phenomenon are not caused solely by the response speed of the liquid crystal, and have also been reported by institutions such as the NHK Broadcasting Technology Research Laboratory as being caused by the display process (for example, refer to the 1999 Conference of the Electronic Information Communication Society, SC-8-1, pp.207–208). As follows is a description of this problem of the display process, with a comparison of a CRT driving process and an LCD driving process.

FIGS. 22A and 22B are diagrams showing comparative results for the time response of display light of a pixel in a CRT and an LCD, where FIG. 22A shows the time response for a CRT, and FIG. 22B shows the time response for an LCD. As shown in FIG. 22A, the CRT is a so-called in-pulse type display device where light is generated for only several milliseconds from the time the electron beam strikes the fluorescent substance of the tube surface, whereas the LCD shown in FIG. 22B is a so-called hold type display device where the display light is retained for one field period from the time the writing of data to the pixel has finished until the next write occurs.

When motion pictures are displayed on a CRT and an LCD with the above characteristics, the displays shown in FIGS. 23A and 23B results. FIGS. 23A and 23B are diagrams showing a sample image display in the case where motion pictures are displayed on a CRT and an LCD, where FIG. 23A represents a sample CRT display and FIG. 23B represents a sample LCD display. FIG. 23A and FIG. 23B represent the case of a circular display object moving in a direction x shown in the figures. In such a case, then as shown in FIG. 23A, in the in-pulse type display device CRT, the display object is displayed momentarily at positions corresponding with the time, whereas in a hold type display device LCD the image of the previous field remains until immediately before a new write is performed.

When a person views the motion pictures displayed in the manner shown in FIGS. 23A and 23B, then the motion pictures are perceived in the manner shown in FIGS. 24A and 24B. FIGS. 24A and 24B are diagrams describing the image perceived by a person when a motion picture is displayed on a CRT and an LCD, where FIG. 24A represents the case of a CRT, and FIG. 24B represents the case of an LCD. As shown in FIG. 24A when a motion picture is displayed on an in-pulse type display device CRT, there is no perception at any time of a displayed image overlapping the previous image. However, when a motion picture is displayed on a hold type display device LCD, then due to effects such as the time integral effect of human sight, the currently displayed image is perceived to overlap with the previously displayed image, producing a motion blur problem.

Several improvements have been proposed for overcoming the aforementioned problems which arise when motion pictures are displayed on an LCD. One such improvement is a method where by scanning the scanning lines at a multiple speed, a new image can be written during the period of each field, and motion blur consequently reduced (multiple scan method). However this multiple scan method also suffers from problems in that the frequency becomes very high, and the circuit size increases due to the necessity of creating a new image to be inserted between fields.

Another improvement is a method in which a shutter is provided in the light path of the display and the hold time is shortened (shutter method). In this method, then for example in the case of a transmission type LCD, the back light is flashed and motion blur prevented by blocking the light for a proportion of a single field period.

Furthermore, another process has also been proposed (for example, Japanese Unexamined Patent Application, First Publication No. Hei 10-83169) in which a black image which functions as a shutter is inserted between each set of image data.

FIGS. 25A to 25D are diagrams describing a process of preventing motion blur by inserting a black image between each set of image data. As shown in FIG. 25A, the basis of this process comprises applying a predetermined voltage to the liquid crystal to generate a black display during a horizontal blanking period, and therein prevent motion blur. In other words, following the display of an image for one field, the entire screen is switched to a black display, before the image of the next field is displayed. However, when display is carried out according to this process, the display time differs in a direction perpendicular to the liquid crystal display panel 100, and so as shown in the sample panel display in FIG. 25C, the problem arises of a difference in brightness developing depending on the position on the liquid crystal display panel 100.

Processes for suppressing this difference in brightness have been proposed in Japanese Unexamined Patent Application, First Publication No. Hei 9-127917, Japanese Unexamined Patent Application, First Publication No. Hei 10-62811 and Japanese Unexamined Patent Application, First Publication No. Hei 11-30789, among others. FIG. 26 is a diagram showing the construction of a liquid crystal display for resolving the problem which develops in the process shown in FIG. 25A. The construction shown is that proposed in the aforementioned Japanese Unexamined Patent Application, First Publication No. Hei 9-127917. Those structural elements which are identical with those of the conventional liquid crystal display shown in FIG. 20 are labeled with the same symbols.

FIG. 26 represents the conventional circuit construction shown in FIG. 20 to which has been added a black display write circuit comprising a black signal supply section 120, a black signal supply line 121, a black signal supply scanning line 122, a black signal supply TFT 123 and a scanning line driving circuit 124 for driving the black signal supply scanning line 122. The gate electrode of the black signal supply TFT 123 is connected to the black signal supply scanning line 122, the source electrode of the black signal supply TFT 123 is connected to the black signal supply line 121, and the drain electrode is connected to the drain electrode of the TFT 103 and the pixel electrode 104.

In a liquid crystal display of the above construction, within one field, a voltage corresponding with a black display is applied to the pixel electrode 104, and then a voltage corresponding with the image data is applied to the pixel electrode 104. By using this type of driving process, each scanning line is reset in the same manner as the panel display example shown in FIG. 25B. In other words, following the display of one screen image, rather than performing a reset by switching the entire screen to a black display, by performing the reset in units of scanning lines, the occurrence of a difference in brightness resulting from insertion of a black screen, such as that shown in the panel display example shown in FIG. 25D, is prevented.

In this manner, using the circuit shown in FIG. 26, motion blur can be reduced, and any difference in brightness across the screen can be prevented, but with such a construction, in addition to the conventional liquid crystal display shown in FIG. 20, the black signal supply section 120, the black signal supply line 121, the black signal supply scanning line 122, the black signal supply TFT 123 and the scanning line driving circuit 124 are necessary, and so the circuit construction increases in size which invites problems such as a reduction in the panel numerical aperture.

SUMMARY OF THE INVENTION

The object of the present invention is to provide a driving process for a liquid crystal display which prevents motion blur without resulting in an increase in circuit size or a reduction in panel numerical aperture.

In order to achieve the object, the present invention is a driving process for a liquid crystal display in which a plurality of scanning lines and a plurality of signal lines are disposed in a grid like arrangement, and display of an image corresponding with image data is conducted by selecting any one of the scanning lines at one time, and altering the state of a liquid crystal via the signal line, wherein a first scanning period and a second scanning period are set within a time frame shorter than the time necessary for scanning any one of the aforementioned scanning lines, and an image corresponding with the aforementioned image data is displayed via the aforementioned signal line during the first scanning period, and a monochromatic image is displayed via the aforementioned signal line during the second scanning period.

According to the present invention described above, a driving process for a liquid crystal display is provided in which a plurality of scanning lines and a plurality of signal lines are disposed in a grid like arrangement, and display of an image corresponding with image data is performed by selecting any one of the scanning lines and the signal lines at one time, and altering the state of a liquid crystal, wherein a first scanning period and a second scanning period are set within a time frame shorter than the time necessary for scanning any one of the aforementioned scanning lines, and an image corresponding with the aforementioned image data is displayed via the aforementioned signal line during the first scanning period, and a monochromatic image is displayed via the aforementioned signal line during the second scanning period, and as a result the present invention is able to prevent the appearance of motion blur without any increase in circuit size or any reduction in panel numerical aperture.

In the present invention, in relation to the same scanning line, the first scanning period and the second scanning period may be set with a time separation therebetween, and an image corresponding with the aforementioned image data may be displayed during the first scanning period of a scanning line, and a monochromatic image may be displayed during the second scanning period of a scanning line which is separated by a predetermined number of scanning lines from the scanning line which displayed the aforementioned image.

Furthermore in the present invention, the aforementioned monochromatic image may be displayed across a predetermined number of consequitive scanning lines.

Furthermore in the present invention, signals relating to an image corresponding with the aforementioned image data and the monochromatic image may be output alternately to the aforementioned signal line, and a signal relating to an image corresponding with the aforementioned image data may be output with an inversion in polarity at every aforementioned first scanning period, and a signal relating to the aforementioned monochromatic image may be output with an inversion in polarity at every aforementioned second scanning period.

Furthermore in the present invention, the aforementioned monochromatic image may be a black image.

Furthermore in the present invention, the aforementioned liquid crystal may be constructed so that the display state thereof is white when no voltage is applied and gradually alters to a black display state in accordance with an applied voltage, and moreover the liquid crystal may be positioned between a pixel electrode and a common electrode, and the voltage applied between the pixel electrode and the common electrode when displaying the black image during the aforementioned second scanning period may be greater than the voltage applied between the pixel electrode and the common electrode when producing a black display during the aforementioned first scanning period.

Furthermore in the present invention, the voltage applied between the aforementioned pixel electrode and the aforementioned common electrode may be made variable by holding the voltage applied to the common electrode at a uniform level, and increasing the voltage applied to the pixel electrode via the aforementioned signal line.

Furthermore in the present invention, the voltage applied between the aforementioned pixel electrode and the aforementioned common electrode may be made variable by applying a voltage to the pixel electrode via the aforementioned signal line, and varying the voltage applied to the common electrode.

Furthermore in the present invention, the aforementioned scanning lines may be connected to a plurality of scanning line driving circuits, and the scanning lines may be scanned in sequence by two scanning line driving circuits selected from amongst the plurality of scanning line driving circuits, and during the aforementioned first scanning period, the scanning of one of the aforementioned two selected scanning line driving circuits may be stopped, and during the aforementioned second scanning period, the scanning of the other of the two selected scanning line driving circuits may be stopped.

BRIEF DESCRIPTION OF THE DRAWINGS

FIG. 22A shows the time response for a CRT, and FIG. 22B shows the time response for an LCD.

FIG. 23A represents a sample CRT display and FIG. 23B represents a sample LCD display.

FIG. 24A represents the case of a CRT, and FIG. 24B represents the case of an LCD.

DETAILED DESCRIPTION OF THE PREFERRED EMBODIMENTS

As follows is a detailed description, with reference to the drawings, of a driving process for liquid crystal displays according to embodiments of the present invention.

First Embodiment

Figure 1:
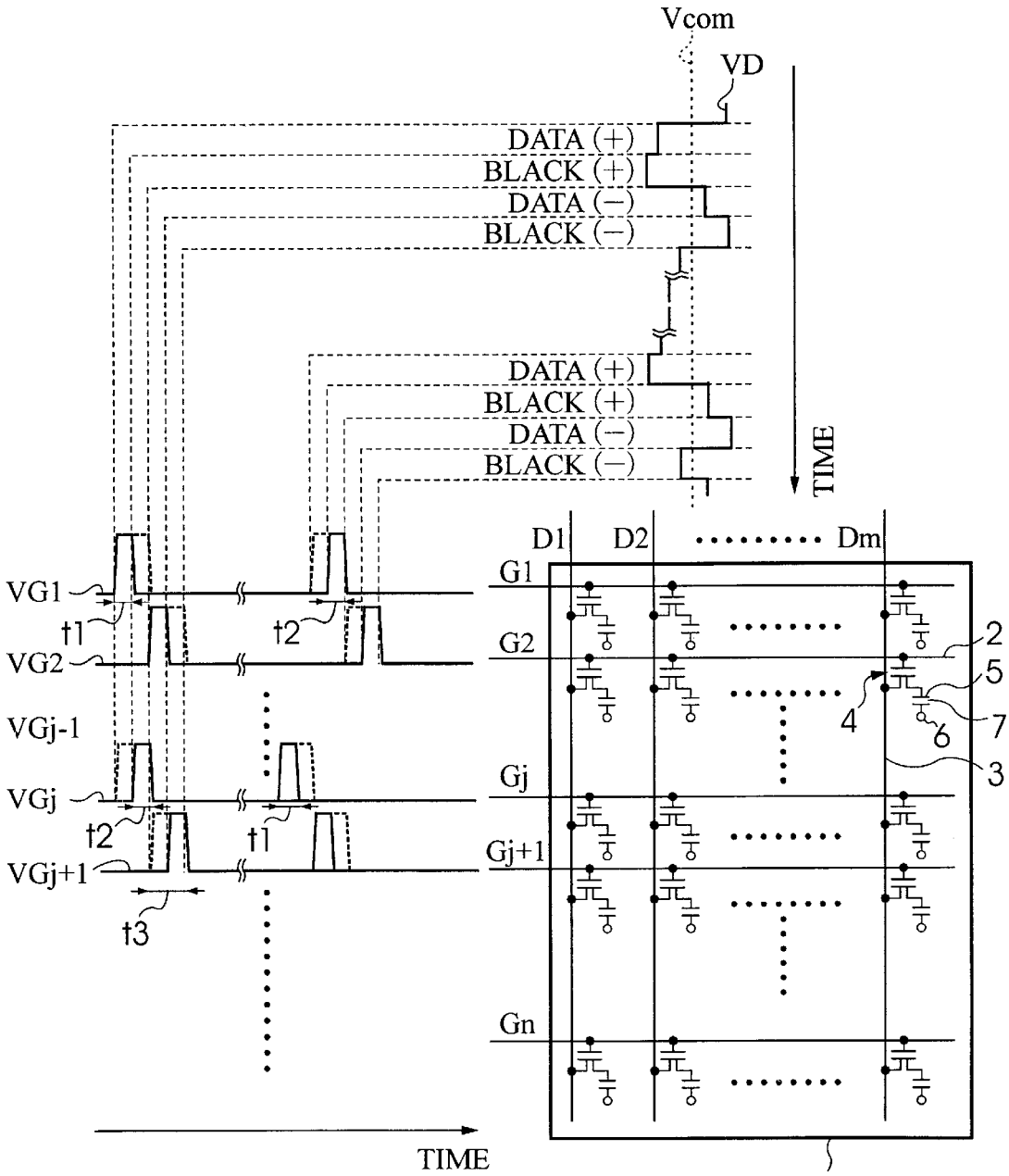
FIG. 1 is a diagram describing the construction of a liquid crystal display applicable to a driving process according to a first embodiment of the present invention, as well as the driving process of the first embodiment of the present invention.

FIG. 1 is a diagram for describing the construction of a liquid crystal display applicable to a driving process according to a first embodiment of the present invention, and describing the driving process according to this first embodiment. In the first embodiment, the construction of a liquid crystal display panel section 1 is no different from conventional constructions, and an improvement is made in the image quality during the display of motion pictures by an inventive modification of the driving signal waveforms applied to each of the electrodes.

Figure 20:
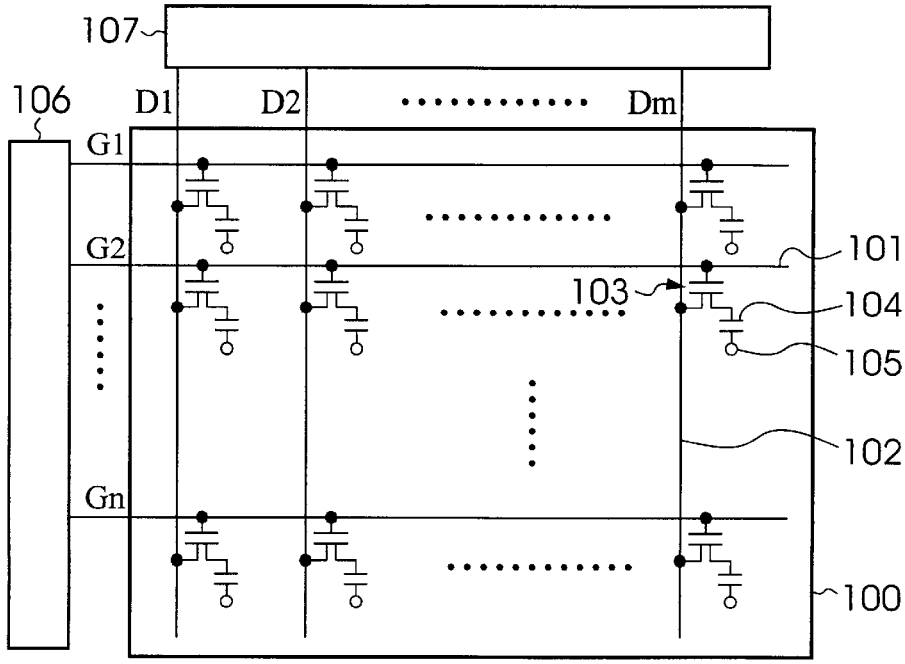
FIG. 20 is a diagram showing a sample construction of a conventional active matrix type LCD.
Figure 21:
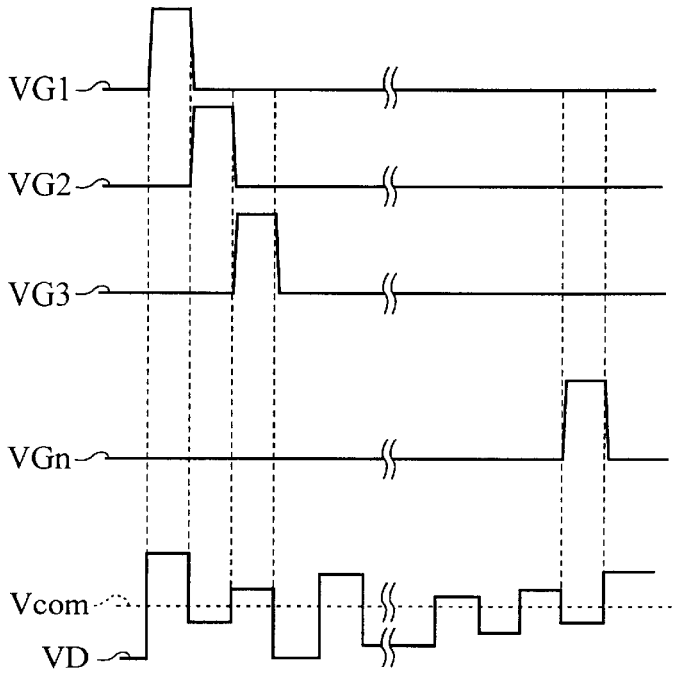
FIG. 21 is a diagram showing waveforms of signals output from a scanning line driving circuit 106 and a signal line driving circuit 107 of a conventional liquid crystal display to scanning lines 101 and signal lines 102.
Figure 22A:
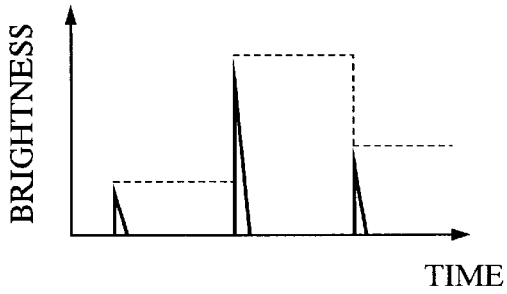
FIGS. 22A and 22B are diagrams showing comparative results for the time response of display light of a pixel in a CRT and an LCD, where
Figure 22B:
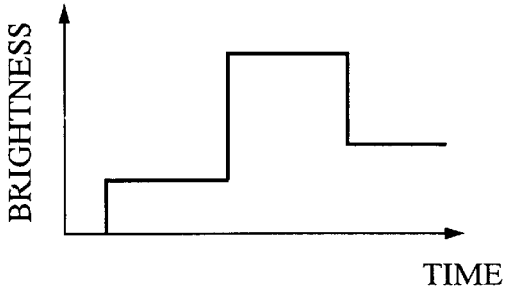
Figure 23A:
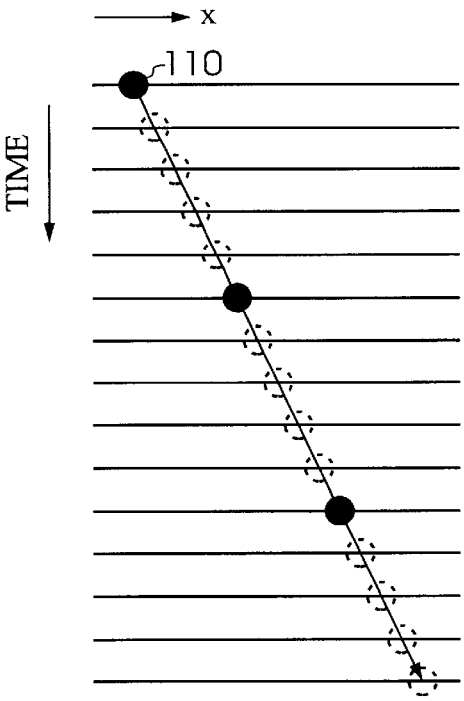
FIGS. 23A and 23B are diagrams showing a sample image display in the case where motion pictures are displayed on a CRT and an LCD, where
Figure 23B:
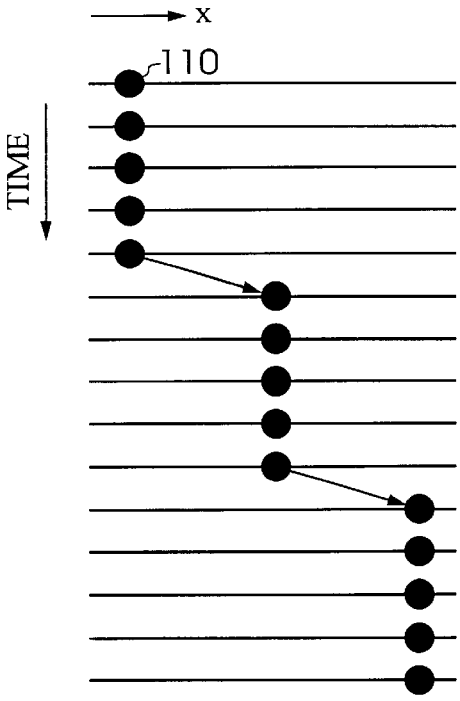
Figure 24A:
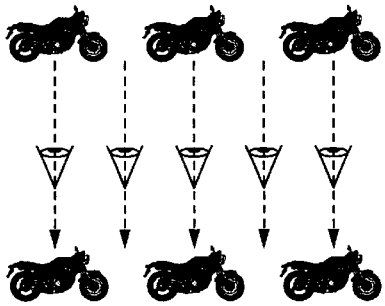
FIGS. 24A and 24B are diagrams describing the image perceived by a person when a motion picture is displayed on a CRT and an LCD, where
Figure 24B:
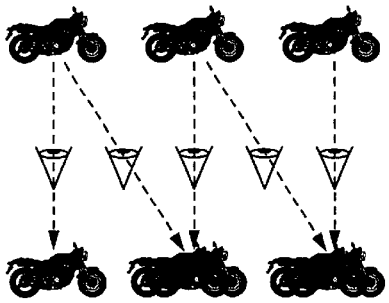
Figure 25A:
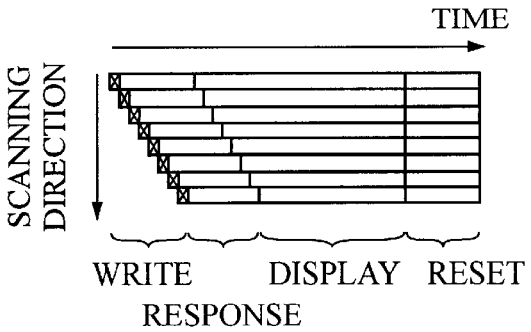
FIGS. 25A to 25D are diagrams describing a process of preventing motion blur inserting a black image between each set of image data.
Figure 25B:
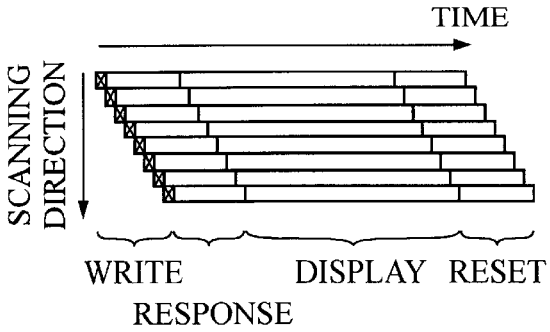
Figure 25C:
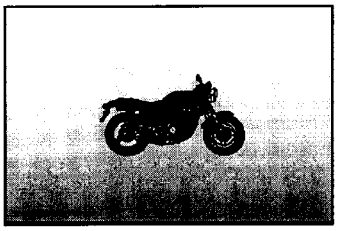
Figure 25D:
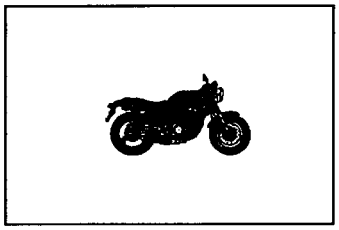
Figure 26:
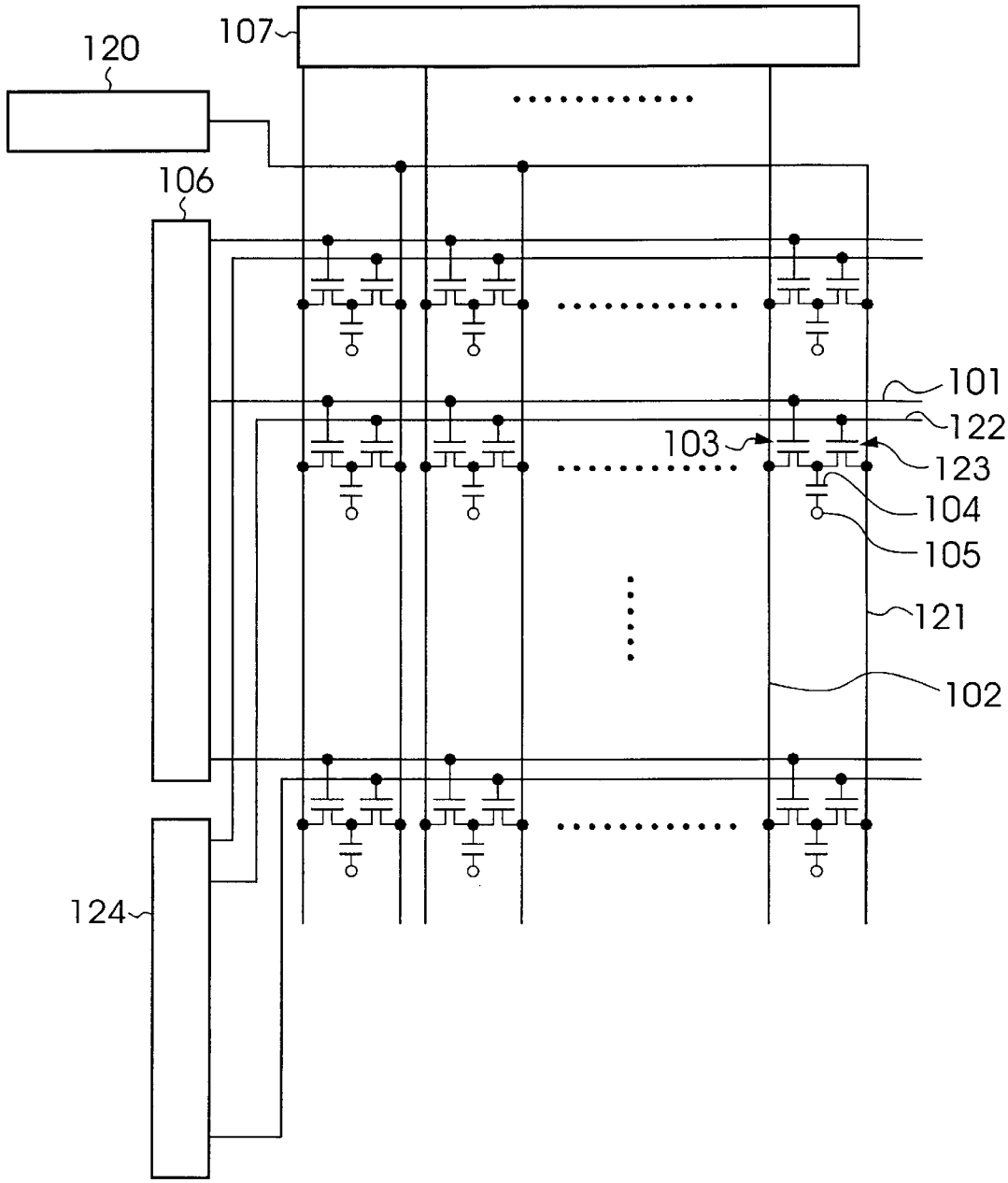
FIG. 26 is a diagram showing the construction of a liquid crystal display for solving a problem which develops in the process shown in FIG. 25A.

In other words in this first embodiment, the liquid crystal display comprises a first and a second glass substrate, and a liquid crystal display panel section 1 on which images are displayed, in the same manner as the conventional liquid crystal display shown in FIG. 20. A number n (where n is a natural number) of scanning lines 2 and a number m (where m is also a natural number) of signal lines 3 are disposed in a grid like arrangement on top of the first glass substrate, and a TFT (thin film transistor) 4 which functions as a non linear element (switching element) is provided in the vicinity of each point of intersection between the scanning lines 2 and the signal lines 3.

A gate electrode of the TFT 4 is connected to the scanning line 2, a source electrode is connected to the signal line 3, and a drain electrode is connected to a pixel electrode 5. The aforementioned second glass substrate is then arranged in a position facing the first glass substrate, and a common electrode 6 is then formed on one surface of the glass substrate with a transference electrode of ITO or the like. Then, a liquid crystal is used to fill the space between the common electrode 6 and the pixel electrode 5 formed on the top of the first glass substrate.

Scanning signals, which are labeled with the symbols VG1 to VGn in FIG. 1, are applied to the scanning lines 2, and a signal which corresponds with the image data and which is labeled with the symbol VD in the figure, is applied to the signal lines 3. As shown in FIG. 1, the scanning signal supplied to each of the scanning lines 2 comprises two scanning line selection periods within one field, namely an image data selection period t1 for writing a gradation voltage corresponding with the image data to the pixel electrode 5, and a black display selection period t2 for writing a voltage corresponding with a black display to the pixel electrode 5. Although in this embodiment a black display is used to emphasize the contrast, other colors may also be used. The gradation voltage corresponding with the image data and the voltage corresponding with the black display are output alternately to each of the signal lines 3.

As shown in FIG. 1, the black display selection period t2, which is a feature of this first embodiment, is approximately ½ of a conventional scanning line selection period t3, and the black display is performed on a scanning line which is either a plurality of lines above, or a plurality of lines below, the scanning line 2 selected by the image data selection period t1. A voltage corresponding with a black display is applied to a signal line 3 in the black display selection period t2, and the contents of a liquid crystal 7 display a black screen, and consequently a so-called reset driving is conducted where a black display is conducted every scanning line.

Next is a detailed description of the operation of a liquid crystal display of the above construction according to the first embodiment of the present invention. In the following description, the plurality of scanning lines 2 are distinguished using the symbols G1 to Gn shown in the figure, and the signal lines 3 are distinguished using the symbols D1 to Dm. For the purposes of this description, the display of the image data is assumed to be performed in a sequence G1, G2 . . . , whereas a black display is performed from a jth scanning line Gj (where j is a natural number, and $1<j\leqq n$).

First, in the image data selection period t1, the scanning line G1 is selected, and in this state, a gradation voltage corresponding with image data is applied to the signal line D1. The TFT 4 connected to the scanning line G1 switches to an ON state, and the liquid crystal contents 7 will show a display corresponding with the image data. Next the scanning line Gj is selected as the black display selection period t2, and in this state, a voltage corresponding with a black display is applied to the signal line 3. When this voltage is applied, the TFT 4 connected to the scanning line Gj switches to an ON state, and the liquid crystal contents 7 will show a black display.

When the black display selection period t2 of the scanning line Gj has elapsed, then next the scanning line G2 is scanned and the same operation as that performed in the scanning of the scanning line G1 is repeated. Then, the scanning line Gj+1 is scanned and the same operation as that performed in the scanning of the scanning line Gj is repeated. The remaining scanning lines 2 are subsequently selected in the sequence G3, Gj+2 . . . . By using this type of driving process, a belt-like black screen display region, such as that shown in FIG. 2, is displayed in the liquid crystal display panel section 1.

Figure 2:
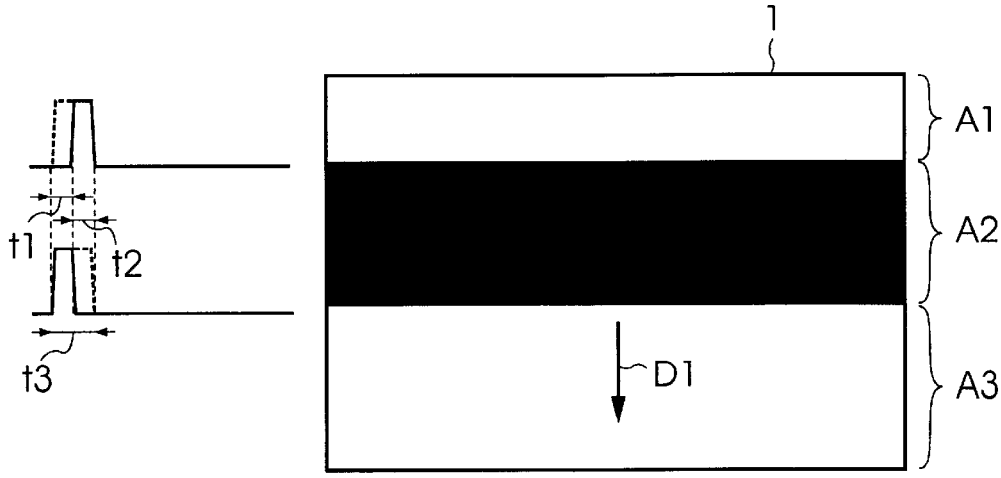
FIG. 2 is a diagram showing the display content displayed momentarily on a liquid crystal display panel section when the liquid crystal display driving process according to the first embodiment of the present invention is used.

FIG. 2 is a diagram showing the display content displayed momentarily on the liquid crystal display panel section 1 when the liquid crystal display driving process according to the first embodiment of the present invention is used. As shown in FIG. 2, in the case where the black display selection period t2 is set in substantially the middle section of the liquid crystal display panel section 1, a single screen comprises three display regions, namely a normal image display region Al, a black screen display region A2 and a normal image display region A3. As time passes, the black screen display region A2 moves in the direction of the arrow labeled with the symbol D1 in FIG. 2, and when the black screen display region A2 reaches the bottom edge of the liquid crystal display panel section 1, then a portion of the black screen display region A2 shifts to the top edge of the liquid crystal display panel section 1, and the area occupied by the black screen display region A2 at the bottom edge decreases, while the area occupied by the black screen display region A2 at the top edge increases while moving down in the direction of the symbol D1.

In this manner, the liquid crystal driving process of the first embodiment is able to prevent motion blur during the display of motion pictures. The spacing between the scanning line selected in the black display selection period t2 and the scanning line selected in the image data selection period t1 becomes the black screen display region A2. Within a single screen, the proportion represented by the black screen display region A2 is set to a value which produces no detectable motion blur during the display of motion pictures. Furthermore, in the driving process of this embodiment, by scrolling the black screen display region A2 one scanning line 2 at a time, in the same manner as the normal image display regions A1 and A3, there is no danger of creating a difference in brightness which varies according to the position on the display screen.

In the driving process according to the first embodiment of the present invention, described above, the description outlined the case where the black display selection period t2 was set following the image data selection period t1, although the same effects can be achieved by reversing the sequence and setting the black display selection period t2 followed by the image data selection period t1.

Figure 3:
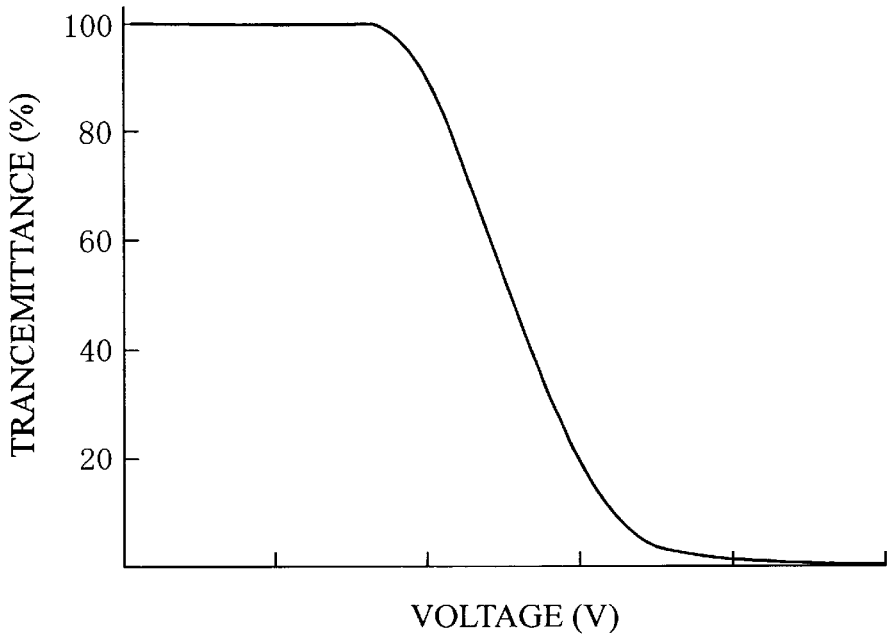
FIG. 3 is a graph showing the voltage—transmittance characteristics of a so-called "normally white" liquid crystal.

Next is a description of a process for polarity inversion of the signal output to the signal line 3. In order to prevent the prolonged application of a DC component voltage to the liquid crystal contents 7, conventionally, so-called AC driving has been used where voltages of positive polarity and negative polarity are applied alternately. As described above, in the first embodiment, the signal VD output to the signal line 3 alternates between a gradation voltage corresponding with the image data, and a voltage corresponding with a black display. In this description, the case is considered where the liquid crystal provided in the liquid crystal display panel section 1 displays the voltage—transmittance characteristics shown in FIG. 3. FIG. 3 is a graph showing the voltage—transmittance characteristics of a so-called "normally white" liquid crystal. As shown in FIG. 3, in the case where the voltage applied to the liquid crystal has a value of 0V, the transmittance of the liquid crystal is substantially 100%, whereas at applied voltages greater than a certain value, the transmittance decreases rapidly, and at even higher voltage values almost no light is transmitted.

If a liquid crystal with the characteristics shown in FIG. 3 is used, then when the polarity is inverted with each output to a signal line 3, as is the case conventionally, then the voltages output to the signal lines 3 follow the sequence "positive gradation voltage corresponding with image data", "negative voltage corresponding with a black display", "positive gradation voltage corresponding with image data", "negative voltage corresponding with a black display" . . . (or, "negative gradation voltage corresponding with image data", "positive voltage corresponding with a black display", "negative gradation voltage corresponding with image data", "positive voltage corresponding with a black display" . . . ), and consequently the voltage corresponding with a black display, which is the largest gradation voltage, is normally of the same polarity, meaning a DC component is applied to the liquid crystal contents 7.

Figure 4:
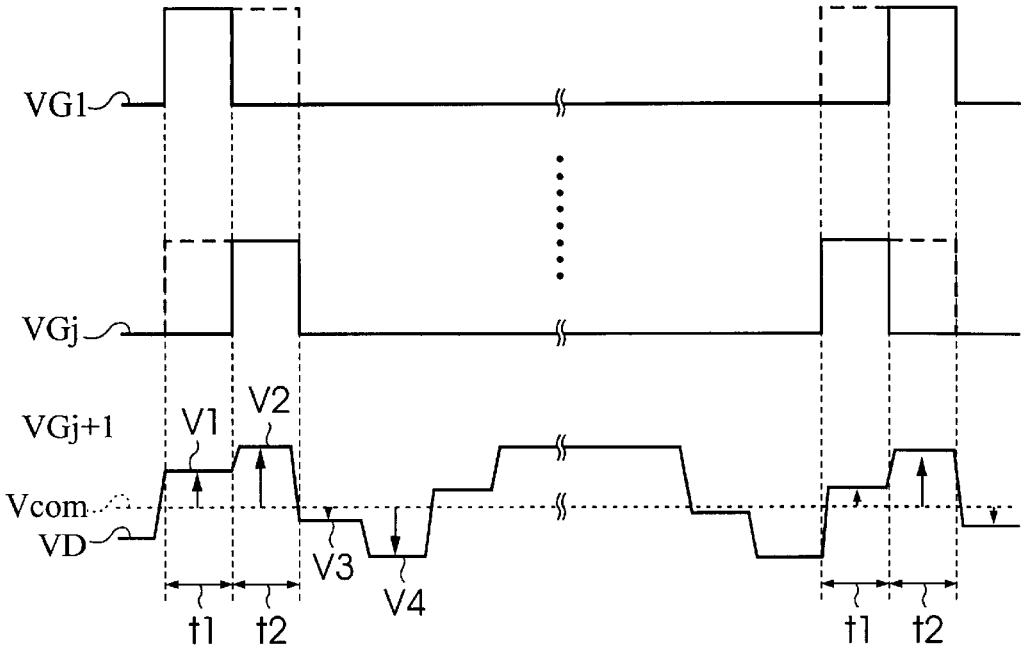
FIG. 4 is a diagram showing one example of polarity inversion of a gradation voltage according to the driving process of the first embodiment.

In this embodiment, in order to resolve the problem described above, the gradation voltage corresponding with image data, and the voltage corresponding with a black display each undergo separate polarity inversion and are then output to the signal lines 3. FIG. 4 is a diagram showing one example of a polarity inversion of a gradation voltage according to the driving process of this first embodiment. In FIG. 4, only the scanning signal VG1 and the scanning signal VGj from FIG. 1 are shown, and the figure shows the time relationship between these two scanning signals and the signal output to the signal line 3.

Figure 5:
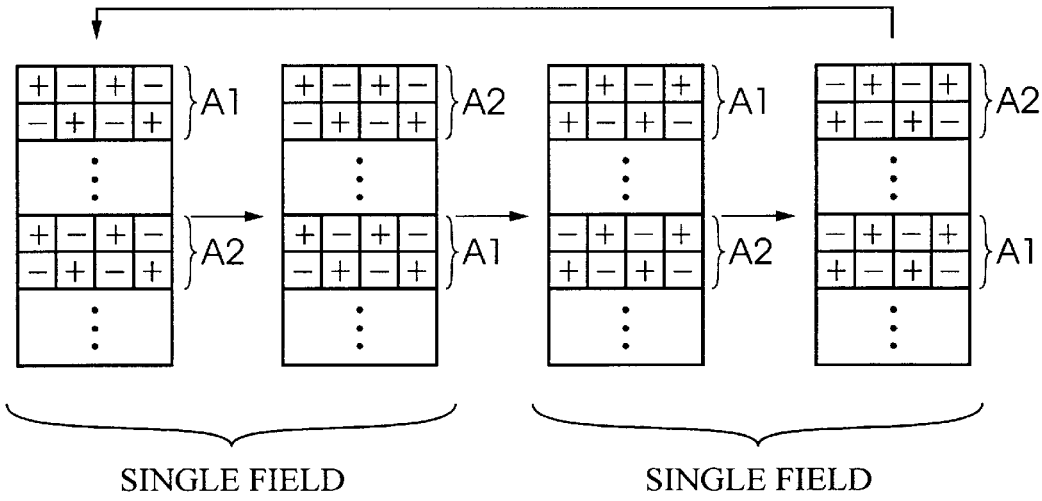
FIG. 5 is a simplified diagram showing the polarity of each pixel in the case where a signal VD shown in FIG. 4 is applied to a signal line.

For example, as is evident from the signal VD in FIG. 4, by outputting to the signal line 3, a signal which varies in the sequence "positive gradation voltage corresponding with image data" V1, "positive voltage corresponding with a black display" V2, "negative gradation voltage corresponding with image data" V3, "negative voltage corresponding with a black display" V4 . . . , the prolonged application of a DC component voltage to the liquid crystal contents 7 can be prevented. Next is a consideration of the polarity of the applied voltage for each pixel. FIG. 5 is a simplified diagram showing the polarity of each pixel in the case where the signal VD shown in FIG. 4 is applied to the signal line 3. As can be seen in FIG. 5, the DC component applied voltage can be cancelled at each pixel within two fields.

Figure 6:
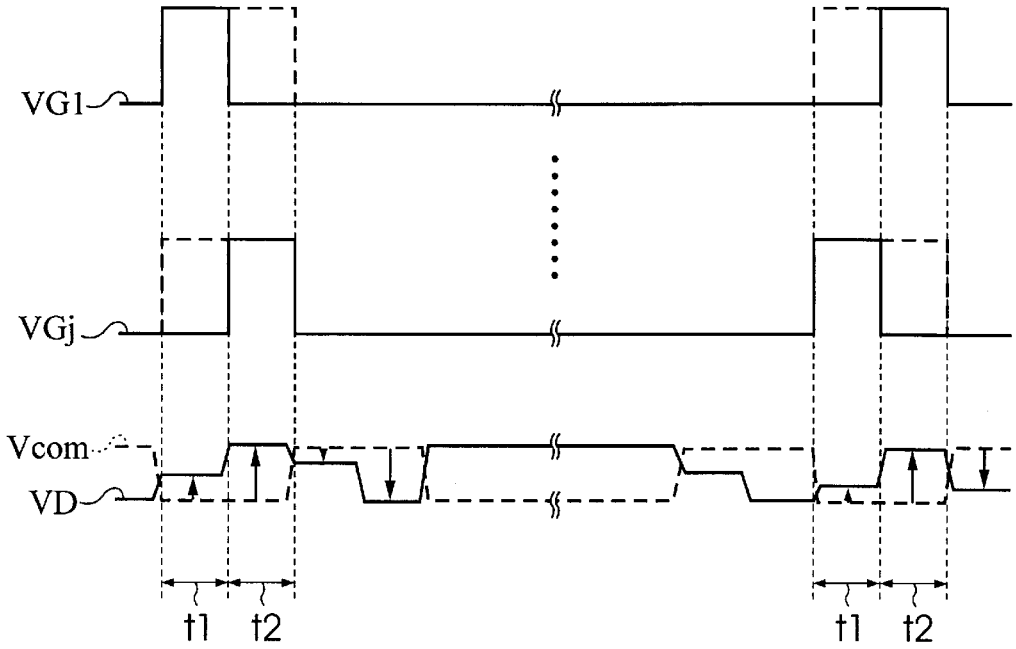
FIG. 6 is a diagram describing the operations in the case where a voltage Vcom applied to a common electrode 6 is AC driven.

In terms of the polarity inversion process, the output to the signal line 3 could also follow the sequence "positive gradation voltage corresponding with image data", "negative voltage corresponding with a black display", "negative gradation voltage corresponding with image data", "positive voltage corresponding with a black display" . . . . Furthermore, in the description FIG. 4, the situation was described where the voltage Vcom applied to the common electrode 6 was uniform, but the voltage Vcom may also be AC driven as shown in FIG. 6. The reason for this is that the voltage applied to the liquid crystal contents 7 is determined by the difference between the common electrode 6, and either the gradation voltage corresponding with image data which is written via the signal line 3, or the voltage corresponding with a black display. FIG. 6 is a diagram describing the operations in the case where the voltage Vcom applied to the common electrode 6 is AC driven. In such a case, as described above, the voltage applied to the liquid crystal contents 7 is determined by the difference between the common electrode 6, and either the gradation voltage corresponding with image data which is written via the signal line 3, or the voltage corresponding with a black display, and so by using AC driving for the voltage Vcom, the voltage written via the signal line 3 may be of low voltage. According to such a driving process, the voltage Vcom will undergo inversion every two selection periods comprising the image data selection period t1 and the black display selection period t2. The timing waveforms of the scanning signals VG1 and VGj in FIG. 4 and FIG. 6 show, as an example, the case where half of the liquid crystal display panel section 1 has been set as a black screen display region.

In the embodiment described above, the description outlined the case where the liquid crystal display panel section 1 comprised "normally white" liquid crystals, but the same effects can be achieved with a so-called "normally black" construction in which the liquid crystals exist in a black display state when no voltage is applied, and then gradually alter to a white display state in accordance with an applied voltage.

As described above, the driving process according to the first embodiment of the present invention, is able to realize the display of motion pictures with no deterioration in image quality, and without altering the conventional construction of the liquid crystal display panel section. Consequently, motion blur can be prevented without any increase in circuit size or any reduction in panel numerical aperture.

Second Embodiment

Figure 7:
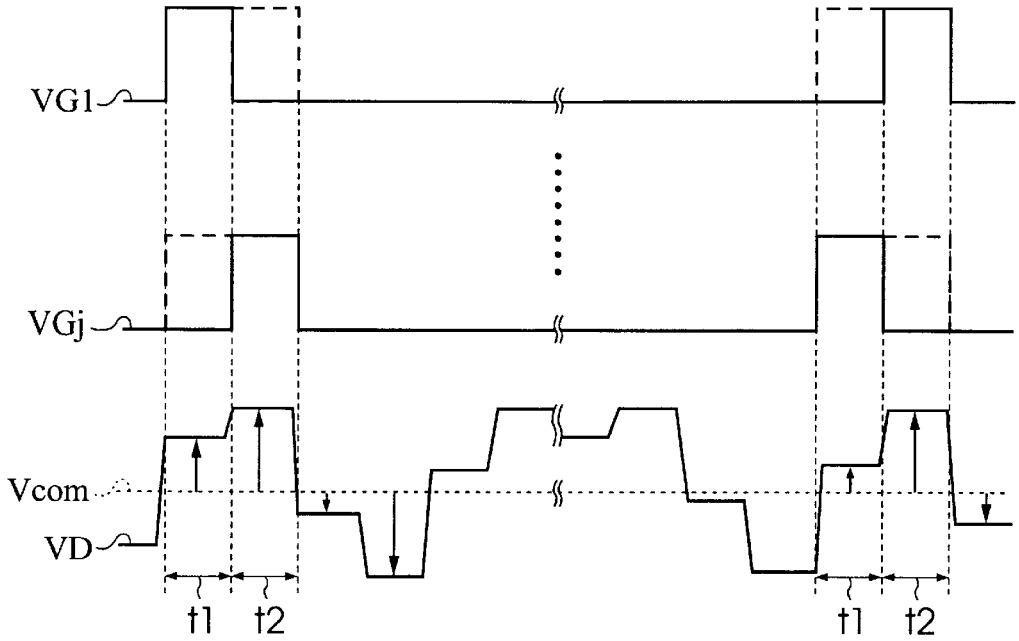
FIG. 7 is a diagram describing the driving process for a liquid crystal display according to a second embodiment of the present invention.

Next is a detailed description of a driving process for a liquid crystal display according to a second embodiment of the present invention. FIG. 7 is a diagram describing the driving process for a liquid crystal display according to the second embodiment of the present invention. As shown in FIG. 7, in this embodiment, a gradation voltage is driven with polarity inversions in the same manner as the driving process shown in FIG. 4, but the driving process of this embodiment differs in that the voltage value corresponding with a black display supplied to a signal line 3 in the black display selection period t2, is set to a greater value than the voltage value in the case where a gradation voltage corresponding with image data supplied to the signal line 3 in the image data selection period t1 is set for a black display. In other words, in this second embodiment, even though the same black display results, the voltage applied to the liquid crystal is set to a greater value for the voltage corresponding with a black display supplied to the signal line 3 in the black display selection period t2. Liquid crystal displays applicable to this embodiment are liquid crystal displays of the type of construction shown in FIG. 1.

This driving process is effective in the case shown in FIG. 2 where it is desirable for the black screen display region A2 to be set to a reduced size. The reason being that in those cases where the black screen display region A2 is set to a reduced size, the time from the black display selection period t2 to the image data selection period t1 is shortened, and so for liquid crystals such as TN mode with a slow response speed, it is possible that the black display cannot be completed.

In general, the response speed of a liquid crystal is determined by a speed Ton at which the liquid crystal molecules rise on the application of an electric field, and a speed Toff with which the liquid crystal molecules return to their original state due to forces between each of the molecules when the electric field is set to zero, and the speeds Ton and Toff are represented by a formula (1) and a formula (2) respectively, shown below.

$$Ton=\eta d^2/(\Delta\in V-K\pi^2) \quad (1)$$

$$Toff=\eta d^2/(K\pi^2) \quad (2)$$

In the formulae, K is a constant represented by the formula $K=K_1+(K_3-2K_2)$ where $K_1$, $K_2$ and $K_3$ represent the divergence, the twist, and the bend elastic modulus respectively of the liquid crystal. Furthermore, ΔÅ represents the difference in dielectric constant between the dielectric constant in the major axial direction of the liquid crystal molecule and the dielectric constant in the minor axial direction, η represents the twist elasticity of the liquid crystal molecule, d represents the thickness of the liquid crystal cell, and V represents the applied voltage.

Figure 8:
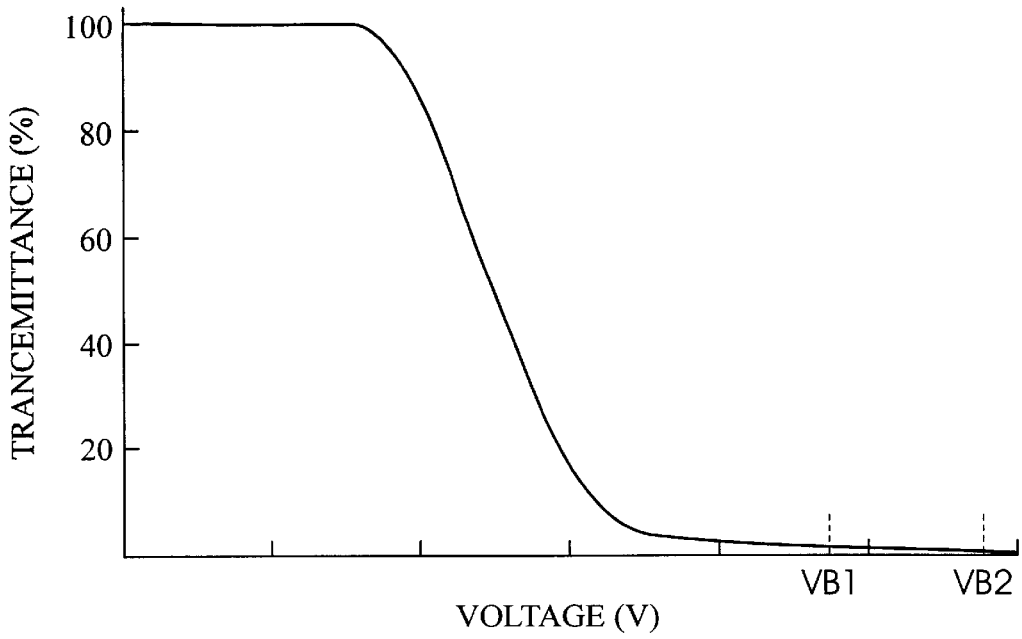
FIG. 8 is a graph showing the voltage—transmittance characteristics of a liquid crystal provided in a liquid crystal display according to the second embodiment of the present invention.

As shown in formula (1) above, the speed at which the liquid crystal molecule rises quickens as the applied voltage increases. The liquid crystals of the liquid crystal display panel section 1 in this second embodiment are normally white, and display the characteristics shown in FIG. 8. FIG. 8 is a graph showing the voltage—transmittance characteristics of a liquid crystal provided in a liquid crystal display according to the second embodiment of the present invention. In FIG. 8, a voltage value $VB_1$ is the voltage value in those cases where a gradation voltage corresponding with image data supplied to the signal line 3 in the image data selection period t1 is set for a black display, and a voltage value $VB_2$ is the voltage value corresponding with a black display supplied to the signal line 3 in the black display selection period t2. In this manner, the voltage value $VB_2$ corresponding with a black display supplied to the signal line 3 in the black display selection period t2, is set at a higher voltage than the voltage value $VB_1$ in those cases where a gradation voltage corresponding with image data supplied to the signal line 3 in the image data selection period t1 is set for a black display. By setting the two voltages in this manner, then even in the case shown in FIG. 2 where the black screen display region A2 is set to a reduced value, the response speed of the liquid crystal remains fast, and as a result a complete black display becomes possible.

Figure 9:
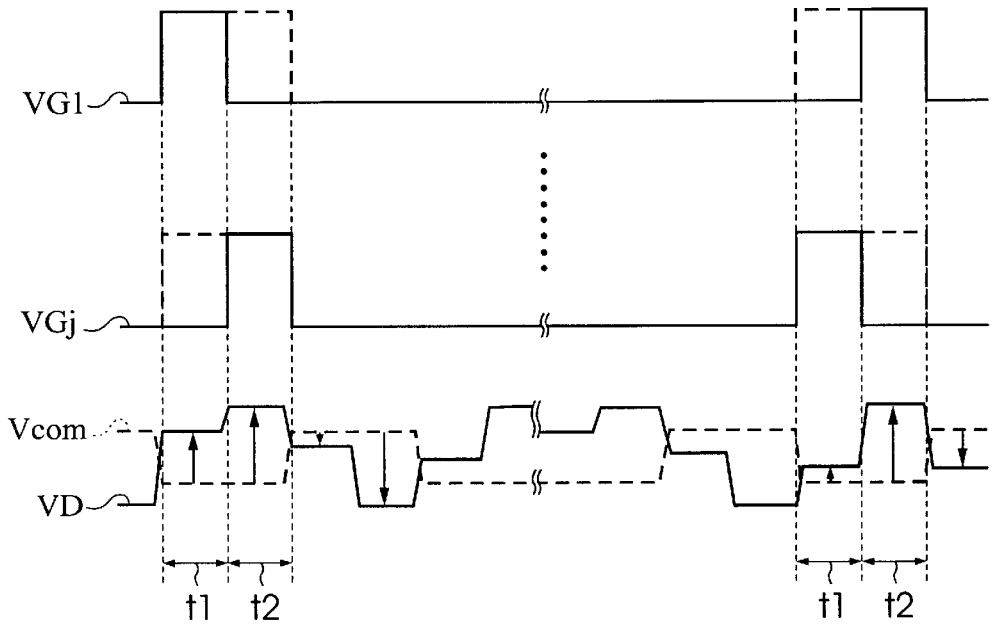
FIG. 9 is a diagram describing the operations in the case where a voltage Vcom applied to a common electrode 6 is AC driven, and a voltage value corresponding with a black display supplied to a signal line 3 in a black display selection period t2, is set at a higher voltage than a voltage value in the case where a gradation voltage corresponding with image data supplied to the signal line 3 in an image data selection period t1 is set for a black display.

Furthermore, the thinking behind this embodiment, namely the setting of the voltage value corresponding with a black display supplied to the signal line 3 in the black display selection period t2, at a higher voltage than the voltage value in those cases where a gradation voltage corresponding with image data supplied to the signal line 3 in the image data selection period t1 is set for a black display, can also be applied to those cases where the common electrode 6 shown in FIG. 6 is AC driven. FIG. 9 is a diagram describing the operations in the case where the voltage Vcom applied to the common electrode 6 is AC driven, and the voltage value corresponding with a black display supplied to the signal line 3 in the black display selection period t2, is set at a higher voltage than the voltage value in the case where a gradation voltage corresponding with image data supplied to the signal line 3 in the image data selection period t1 is set for a black display. Comparison of FIG. 9 and FIG. 6 reveals that the voltage Vcom applied to the common electrode 6 is driven using the same voltage, but the value of the signal VD supplied to the signal line 3 in FIG. 9 is greater than the value of the signal VD shown in FIG. 6. However, comparison of the value of the signal VD shown in FIG. 9 and the value of the signal VD shown in FIG. 7 reveals that the value of the signal VD shown in FIG. 9 should be smaller.

Third Embodiment

Figure 10:
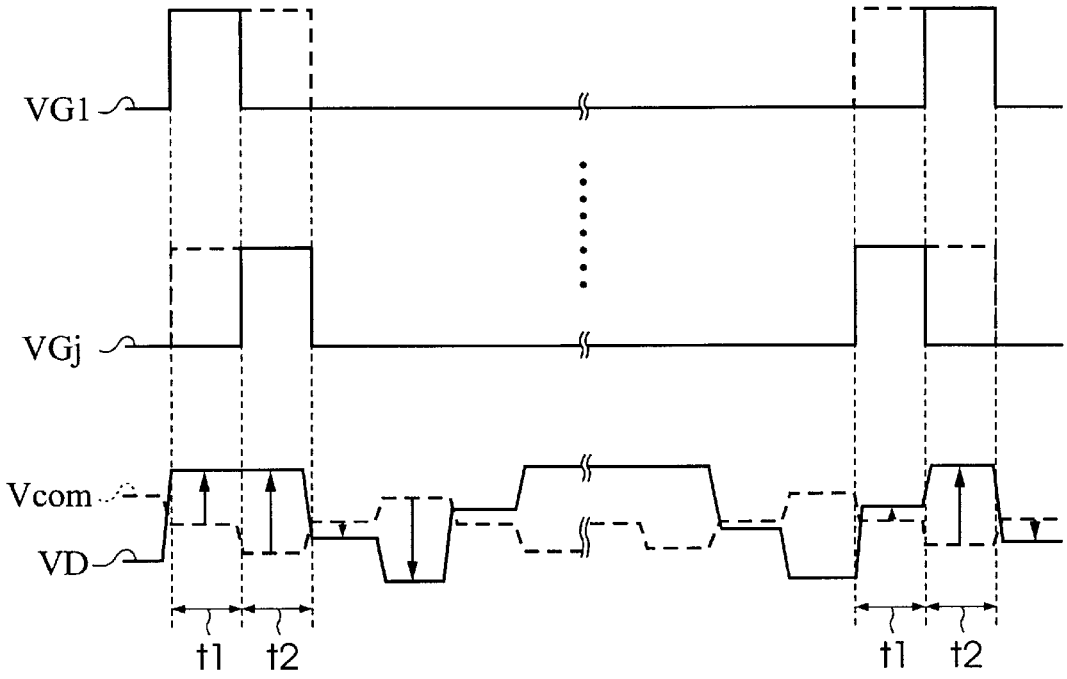
FIG. 10 is a diagram describing a driving process for a liquid crystal display according to a third embodiment of the present invention.

Next is a detailed description of a driving process for a liquid crystal display according to a third embodiment of the present invention. FIG. 10 is a diagram describing the driving process for a liquid crystal display according to the third embodiment of the present invention. As with the previous two embodiments, the third embodiment also relates to the solving of the aforementioned problem, namely the problem which arises in the case where the black screen display region A2 in FIG. 2 is set to a reduced size. A liquid crystal display panel section 1 of the third embodiment is of the same construction as the liquid crystal display panel section 1 shown in FIG. 1, and comprises normally white liquid crystals.

As shown in FIG. 10, the driving process of this third embodiment carries out AC driving by driving the voltage Vcom, in the same manner as the driving process shown in FIG. 9. However, in the driving process shown in FIG. 9, the value of the voltage Vcom supplied to the common electrode 6 in the image data selection period t1, and the value of the voltage Vcom supplied to the common electrode 6 in the black display selection period t2 are identical, whereas in the driving process according to the third embodiment shown in FIG. 10, the value of the voltage Vcom supplied to the common electrode 6 in the image data selection period t1, and the value of the voltage Vcom supplied to the common electrode 6 in the black display selection period t2 are varied. Furthermore in FIG. 10, the voltage value corresponding with a black display supplied to the signal line 3 in the black display selection period t2, and the voltage value in those cases where a gradation voltage corresponding with image data supplied to the signal line 3 in the image data selection period t1 is set for a black display, are set to identical values.

In other words, the difference between the driving process shown in FIG. 10 and the driving process shown in FIG. 9 is that whereas in FIG. 9 the value of the voltage supplied to the signal line 3 is varied, in FIG. 10 the value of the voltage supplied to the common electrode 6 is varied. By performing driving according to a driving process of the type shown in FIG. 10, the same effects as the driving processes shown in FIG. 7 and FIG. 9 can be achieved. The timing waveforms of the scanning signals VG1 and VGj in FIG. 7, FIG. 9 and FIG. 10 show, as an example, the case where half of the liquid crystal display panel section 1 has been set as a black screen display region.

Fourth Embodiment

Figure 11:
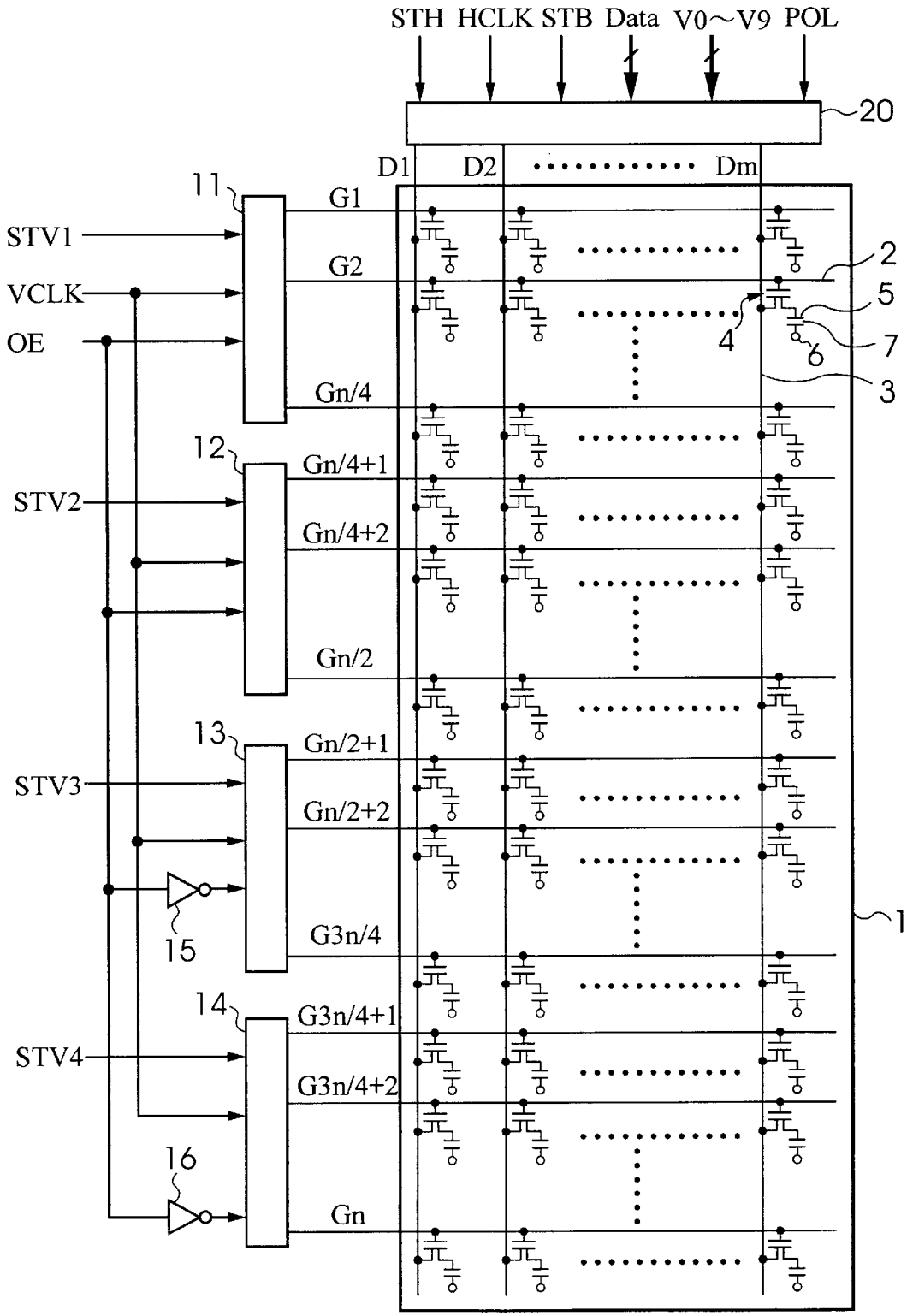
FIG. 11 is a diagram showing the construction of a liquid crystal display applicable to a liquid crystal display driving process according to a fourth embodiment of the present invention.

Next is a detailed description of a driving process for a liquid crystal display according to a fourth embodiment of the present invention. FIG. 11 is a diagram showing the construction of a liquid crystal display applicable to the liquid crystal display driving process according to the fourth embodiment of the present invention. A liquid crystal display applicable to the liquid crystal display driving process according to the fourth embodiment of the present invention comprises a first and a second glass substrate, and a liquid crystal display panel section 1 on which images are displayed, in the same manner as the liquid crystal display applicable to the liquid crystal display driving process according to the first embodiment of the present invention shown in FIG. 1. A number n (where n is a natural number) of scanning lines 2 and a number m (where m is also a natural number) of signal lines 3 are disposed in a grid like arrangement on top of the first glass substrate, and a TFT 4 which functions as a non linear element (switching element) is provided in the vicinity of each point of intersection between the scanning lines 2 and the signal lines 3.

A gate electrode of the TFT 4 is connected to the scanning line 2, a source electrode is connected to the signal line 3, and a drain electrode is connected to a pixel electrode 5. The aforementioned second glass substrate is then arranged in a position facing the first glass substrate, and a common electrode is 6 then formed on one surface of the glass substrate with a transference electrode of ITO or the like. Then, a liquid crystal is used to fill the space between the common electrode 6 and the pixel electrode 5 formed on the top of the first glass substrate.

The scanning lines 2 are connected to different scanning line driving circuits 11 to 14 depending on the position in which they are located within the liquid crystal display panel section 1. In other words, the n/4 scanning lines 2 from the top of the liquid crystal display panel section 1 are connected to the scanning line driving circuit 11, the next n/4 scanning lines 2 are connected to the scanning line driving circuit 12, the next n/4 scanning lines 2 are connected to the scanning line driving circuit 13, and the final n/4 scanning lines 2 are connected to the scanning line driving circuit 14. Scanning start pulses STV1 to STV4 are supplied to each of the scanning line driving circuits 11 to 14 respectively, and a scanning clock VCLK is also input to each of the scanning line driving circuits 11 to 14. Furthermore, an output control signal OE is input into the scanning line driving circuits 11 and 12, and a signal produced by inverting the output control signal OE with inverter circuits 15, 16 is input into the scanning line driving circuits 13 and 14. In this specification documentation, for ease of description, the signal produced by inverting the output control signal OE is referred to as an output control signal OE−.

The scanning start pulses STV1 to STV4 are each signals in which two pulses are input within one field, and when the scanning start pulses STV1 to STV4 are input, the scanning line driving circuits 11 to 14, in synchronization with the input scanning clock VCLK, perform sequential scanning of the connected scanning lines, starting from the scanning line 2 positioned closest to the top of the liquid crystal display panel section 1. The output control signal OE is a signal for controlling the scanning line driving circuits 11 to 14 so that a scanning lines 2 is not scanned. Furthermore, the signal lines 3 are connected to a signal line driving circuit 20, and a signal start pulse STH, a data input clock HCLK, an output control signal STB, data, reference gradation voltages V0 to V9, and a polarity inversion control signal POL are input into the signal line driving circuit 20. Based on these input signals, the signal line driving circuit 20 generates the signal VD which is then output to each of the signal lines 3. Based on the polarity inversion control signal POL, the polarity of the voltage output to the signal lines 3 is controlled so as to be inverted after every second output. By conducting a polarity inversion in this manner, the application of a DC voltage to the liquid crystals can be prevented.

Figure 12:
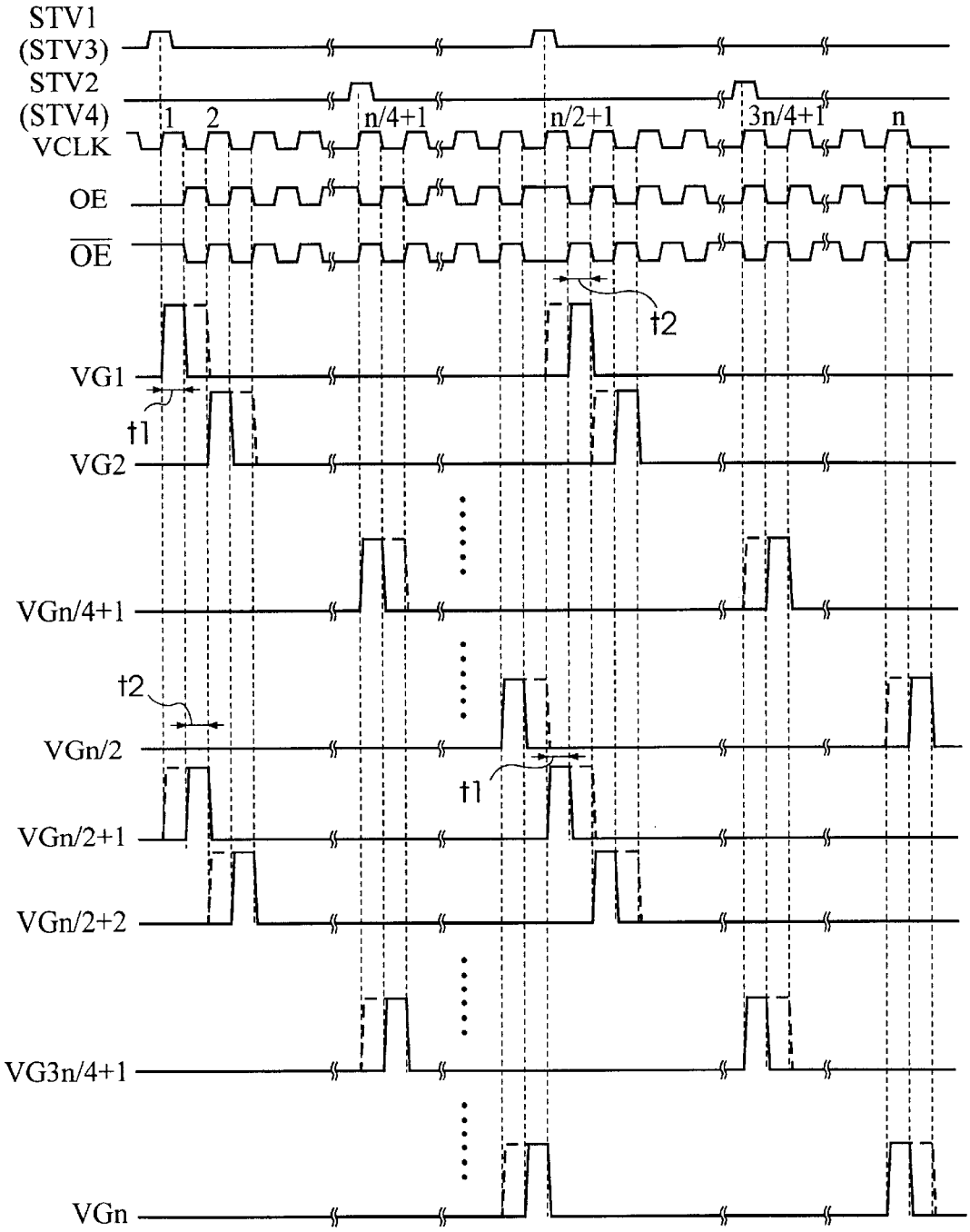
FIG. 12 is a timing chart of signals transmitted in a liquid crystal display applicable to the liquid crystal display driving process according to the fourth embodiment of the present invention.

FIG. 12 is a timing chart of signals transmitted in a liquid crystal display applicable to the liquid crystal display driving process according to the fourth embodiment of the present invention. As is shown in FIG. 12, the scanning start pulses STV1 and STV3 input into the scanning line driving circuits 11 and 13 respectively are in-phase pulse signals, and the scanning start pulses STV2 and STV4 input into the scanning line driving circuits 12 and 14 respectively are signals which have the same cycle length as the scanning start pulses STV1 and STV3, but are one half cycle out of phase in relation to the scanning start pulses STV1 and STV3.

Furthermore, the scanning clock VCLK supplied to the scanning line driving circuits 11 to 14 is a clock with a cycle which is half that of conventional scanning clocks. Furthermore, in this embodiment, two scanning line selection periods are provided within one field, namely the image data selection period t1 for writing a gradation voltage corresponding with image data to the pixel electrode 5, and the black display selection period t2 for writing a voltage corresponding with a black display to the pixel electrode 5.

Scanning signals VG1 to VGn shown in FIG. 12 are signals supplied to each of the scanning lines labeled with the symbols G1 to Gn respectively in FIG. 11. In the fourth embodiment, gradation voltages corresponding with image data are written in a sequence starting from the scanning line 2 labeled with the symbol G1 in FIG. 11, and a voltage corresponding with a black display is written in a sequence starting from the scanning line 2 labeled with the symbol Gn/2+1 in FIG. 11, positioned in the central section of the liquid crystal display panel section 1. In the black display selection period t2, a voltage corresponding with a black display is applied to the signal lines 3, and the contents of the liquid crystals 7 display a black screen, and so the so-called reset driving is conducted where a black display is conducted every scanning line. Moreover, although in this embodiment a black display is used to emphasize the contrast, other colors may also be used. Furthermore, the gradation voltage corresponding with the image data and the voltage corresponding with the black display are output alternately to each of the signal lines 3.

Next is a detailed description of the operation of the liquid crystal display shown in FIG. 11. Firstly, when the scanning start pulses STV1 and STV3 are input into the scanning line driving circuits 11 and 13 respectively, the scanning line driving circuit 11 scans the scanning line 2 labeled with the symbol G1 in FIG. 11, and the scanning line driving circuit 13 begins scanning the scanning line 2 labeled with the symbol Gn/2+1 in FIG. 11. However, as is evident from reference to FIG. 12, at this point the output control signal OE input into the scanning line driving circuit 11 is low level, and the output control signal OE- input into the scanning line driving circuit 13 is high level, and so in effect only the scanning line 2 labeled with the symbol G1 is scanned. During the image data selection period t1 when the scanning line 2 labeled with the symbol G1 is being scanned, the signal line driving circuit 20 writes a gradation voltage corresponding with image data to the pixel electrode 5, via the TFT 4 connected to the scanning line 2 labeled with the symbol G1.

When the image data selection period t1 ends, the process shifts to the black display selection period t2, and the output control signal OE input into the scanning line driving circuit 11 becomes high level, and the output control signal OE- input into the scanning line driving circuit 13 becomes low level. Consequently, in the black display selection period t2, only the scanning line 2 labeled with the symbol Gn/2+1 is scanned. During the black display selection period t2 when the scanning line 2 labeled with the symbol Gn/2+1 is being scanned, the signal line driving circuit 20 writes a voltage corresponding with a black display to the pixel electrode 5, via the TFT 4 connected to the scanning line 2 labeled with the symbol Gn/2+1. Subsequently, the scanning line driving circuit 11 scans the scanning line 2 labeled with the symbol G2 in FIG. 11, and the scanning line driving circuit 13 scans the scanning line 2 labeled with the symbol Gn/2+2 in FIG. 11, and the operation described above is repeated.

When the scanning line driving circuit 11 and the scanning line driving circuit 13 have completed scanning all of the scanning lines 2 connected thereto, then the scanning start pulses STV2 and STV4 are input into the scanning line driving circuits 12 and 14 respectively, and the scanning line driving circuit 12 scans the scanning line 2 labeled with the symbol Gn/4+1 in FIG. 11, and the scanning line driving circuit 14 scans the scanning line 2 labeled with the symbol G3n/4+1 in FIG. 11. At this point, the output control signal OE input into the scanning line driving circuit 12 is low level, and the output control signal OE- input into the scanning line driving circuit 14 is high level. Consequently, in effect only the scanning line 2 labeled with the symbol Gn/4+1 is scanned. During the image data selection period t1 when the scanning line 2 labeled with the symbol Gn/4+1 is being scanned, the signal line driving circuit 20 writes a gradation voltage corresponding with image data to the pixel electrode 5, via the TFT 4 connected to the scanning line 2 labeled with the symbol Gn/4+1.

When the image data selection period t1 ends, the process shifts to the black display selection period t2, and the output control signal OE input into the scanning line driving circuit 11 becomes high level, and the output control signal OE- input into the scanning line driving circuit 13 becomes low level. Consequently, in the black display selection period t2, only the scanning line 2 labeled with the symbol G3n/4+1 is scanned. During the black display selection period t2 when the scanning line 2 labeled with the symbol G3n/4+1 is being scanned, the signal line driving circuit 20 writes a voltage corresponding with a black display to the pixel electrode 5, via the TFT 4 connected to the scanning line 2 labeled with the symbol G3n/4+1. Subsequently, the scanning line driving circuit 12 scans the scanning line 2 labeled with the symbol Gn/4+2 in FIG. 11, and the scanning line driving circuit 14 scans the scanning line 2 labeled with the symbol G3n/4+2 in FIG. 11, and the operation described above is repeated.

When the scanning line driving circuit 12 and the scanning line driving circuit 14 have completed scanning all of the scanning lines 2 connected thereto, then the scanning start pulses STV1 and STV3 are input into the scanning line driving circuits 11 and 13 respectively, and the scanning line driving circuit 11 scans the scanning line 2 labeled with the symbol G1 in FIG. 11, and the scanning line driving circuit 13 begins scanning the scanning line 2 labeled with the symbol Gn/2+1 in FIG. 11. As is evident from reference to FIG. 12, at this point because the phases of the output control signal OE and the output control signal OE- have been inverted, then during the image data selection period t1 the output control signal OE input into the scanning line driving circuit 11 is high level, and the output control signal OE- input into the scanning line driving circuit 13 is low level. As a result, in effect only the scanning line 2 labeled with the symbol Gn/2+1 is scanned. During the image data selection period t1 when the scanning line 2 labeled with the symbol Gn/2+1 is being scanned, the signal line driving circuit 20 writes a gradation voltage corresponding with image data to the pixel electrode 5, via the TFT 4 connected to the scanning line 2 labeled with the symbol Gn/2+1.

When the image data selection period t1 ends, the process shifts to the black display selection period t2, and the output control signal OE input into the scanning line driving circuit 11 becomes low level, and the output control signal OE- input into the scanning line driving circuit 13 becomes high level. Consequently, in the black display selection period t2, only the scanning line 2 labeled with the symbol G1 is scanned. During the black display selection period t2 when the scanning line 2 labeled with the symbol G1 is being scanned, the signal line driving circuit 20 writes a voltage corresponding with a black display to the pixel electrode 5, via the TFT 4 connected to the scanning line 2 labeled with the symbol G1. Subsequently, the scanning line driving circuit 11 scans the scanning line 2 labeled with the symbol G2 in FIG. 11, and the scanning line driving circuit 13 scans the scanning line 2 labeled with the symbol Gn/2+2 in FIG. 11, and the operation described above is repeated.

When the scanning line driving circuit 11 and the scanning line driving circuit 13 have completed scanning all of the scanning lines 2 connected thereto, then the scanning start pulses STV2 and STV4 are input into the scanning line driving circuits 12 and 14 respectively, and the scanning line driving circuit 12 scans the scanning line 2 labeled with the symbol Gn/4+1 in FIG. 11, and the scanning line driving circuit 14 scans the scanning line 2 labeled with the symbol G3n/4+1 in FIG. 11. At this point, the output control signal OE input into the scanning line driving circuit 12 is high level, and the output control signal OE- input into the scanning line driving circuit 14 is low level. Consequently, in effect only the scanning line 2 labeled with the symbol G3n/4+1 is scanned. During the image data selection period t1 when the scanning line 2 labeled with the symbol G3n/4+1 is being scanned, the signal line driving circuit 20 writes a gradation voltage corresponding with image data to the pixel electrode 5, via the TFT 4 connected to the scanning line 2 labeled with the symbol G3n/4+1.

When the image data selection period t1 ends, the process shifts to the black display selection period t2, and the output control signal OE input into the scanning line driving circuit 11 becomes low level, and the output control signal OE- input into the scanning line driving circuit 13 becomes high level. Consequently, in the black display selection period t2, only the scanning line 2 labeled with the symbol Gn/4+1 is scanned. During the black display selection period t2 when the scanning line 2 labeled with the symbol Gn/4+1 is being scanned, the signal line driving circuit 20 writes a voltage corresponding with a black display to the pixel electrode 5, via the TFT 4 connected to the scanning line 2 labeled with the symbol Gn/4+1. Subsequently, the scanning line driving circuit 12 scans the scanning line 2 labeled with the symbol Gn/4+2 in FIG. 11, and the scanning line driving circuit 14 scans the scanning line 2 labeled with the symbol G3n/4+2 in FIG. 11, and the operation described above is repeated, and when the scanning of all connected scanning lines 2 is completed, the writing of one field finishes.

In FIG. 11, the description outlines an example in which four scanning line driving circuits 11 to 14 were provided, but this embodiment is not constrained by the number of scanning line driving circuits.

Next is a comparison of the liquid crystal display driving process of the fourth embodiment of the present invention, and a conventional liquid crystal display driving process, in order to clarify the differences between the processes.

Figure 13:
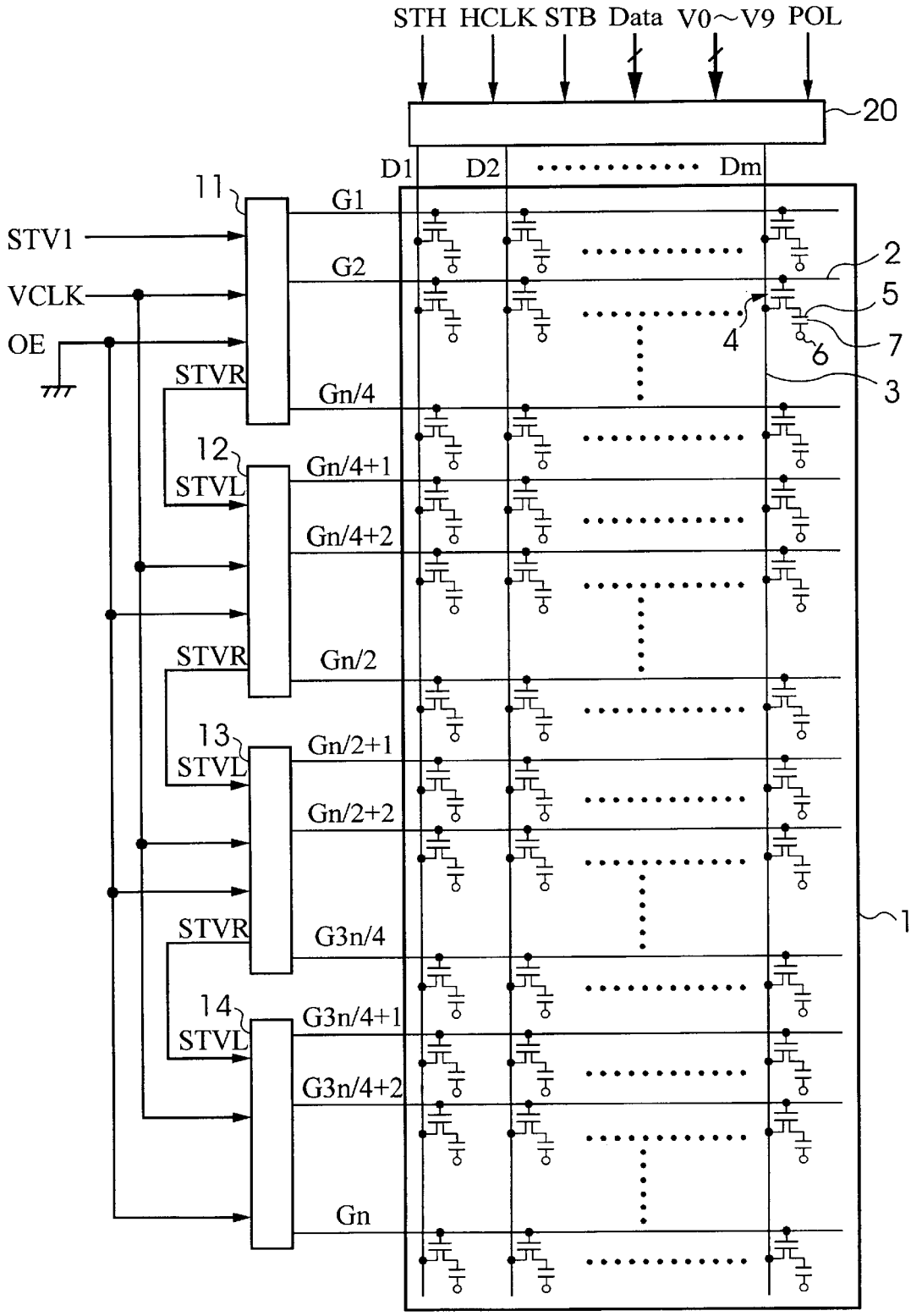
FIG. 13 is a diagram showing the construction of a liquid crystal display applicable to a conventional liquid crystal display driving process.
Figure 14:
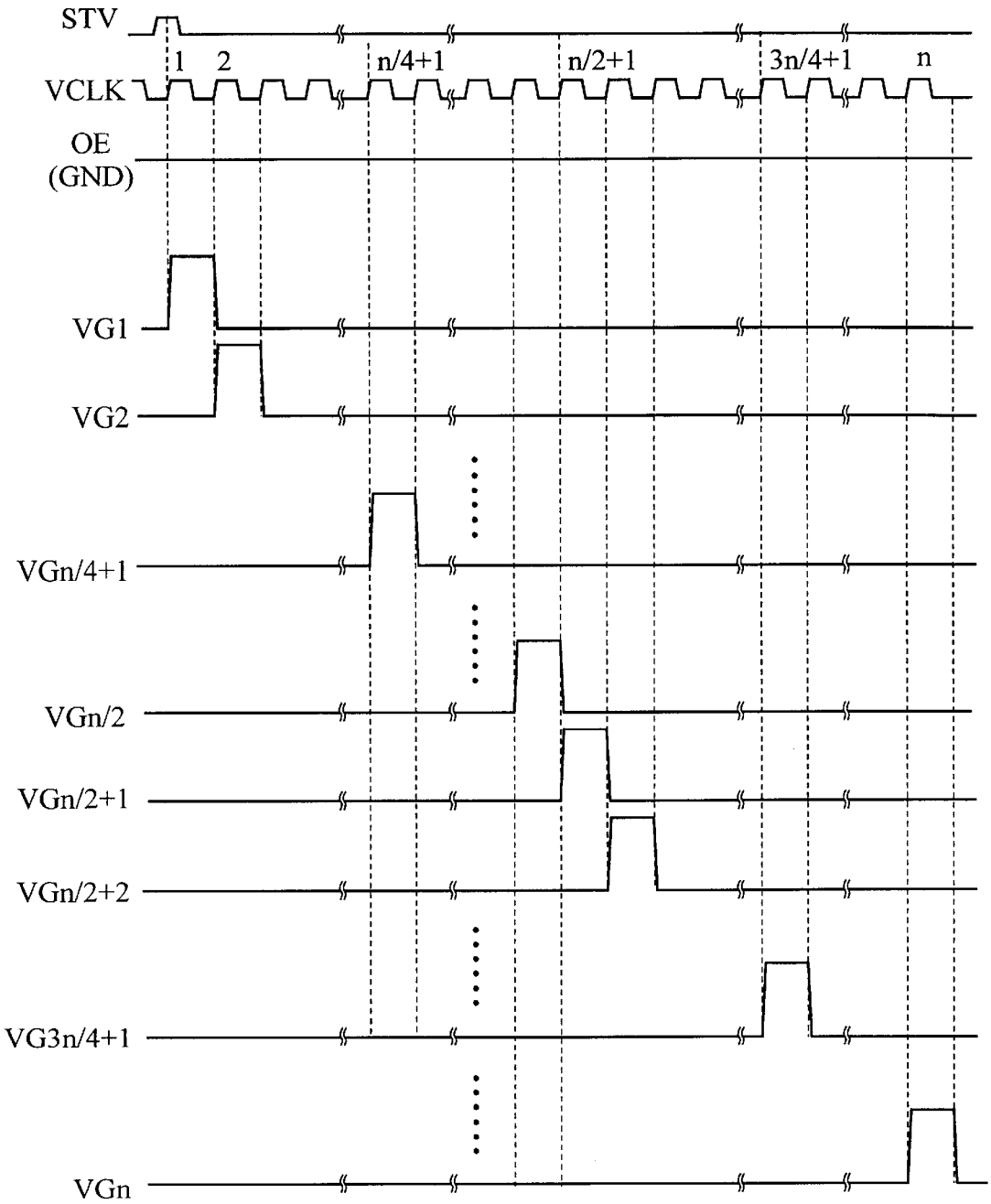
FIG. 14 is a timing chart representing a conventional liquid crystal display driving process.

FIG. 13 is a diagram showing the construction of a liquid crystal display applicable to a conventional liquid crystal display driving process, and FIG. 14 is a timing chart representing the conventional liquid crystal display driving process. The construction of the liquid crystal display applicable to a conventional liquid crystal display driving process shown in FIG. 13 is almost identical with the construction of the liquid crystal display according to the fourth embodiment of the present invention shown in FIG. 13. However, the construction in FIG. 13 differs in that the input terminal from which the output control signal OE is input is grounded, and the scanning start pulse STV1 is input only into the scanning line driving circuit 11, whereas a shift start pulse STVR output from the scanning line driving circuit 11 is input into the scanning line driving circuit 12 as a start pulse STVL, a shift start pulse STVR output from the scanning line driving circuit 12 is input into the scanning line driving circuit 13 as a start pulse STVL, and a shift start pulse STVR output from the scanning line driving circuit 13 is input into the scanning line driving circuit 14 as a start pulse STVL.

In other words, in the conventional liquid crystal display shown in FIG. 13, the scanning line driving circuit 11 is connected in tandem, and scanning is performed starting from the scanning line labeled with the symbol GI, and then proceeds in a sequence to the scanning lines labeled with the symbols G2, G3 . . . Gn. The output number of the scanning line driving circuits 11 to 14 is limited, and normally each scanning line 2 is driven by a plurality of the scanning line driving circuits 11 to 14. Furthermore, a polarity inversion control signal POL which is able to invert the polarity of the voltage output to the signal lines 3 is input into a signal line driving circuit 208, and the polarity inversion control signal POL is controlled so that the polarity of the voltage output to the signal lines 3 is inverted after each output.

In this manner, the constructions of the conventional liquid crystal display shown in FIG. 13 and the liquid crystal display according to the fourth embodiment of the present invention are substantially the same, although in the fourth embodiment of the present invention, an image data selection period t1 and a black display selection period t2 are provided, and moreover by controlling the process using the output control signal OE and the output control signal OE- so that only one scanning line 2 is scanned at any one time, the so-called reset driving is conducted where a black display is performed every scanning line. In the fourth embodiment, the liquid crystal display panel section 1, which is of the same construction as that in a conventional liquid crystal display, is constructed using the signal line driving circuit 20 and the scanning line driving circuits 11 to 14, and so motion blur during the display of motion pictures can be improved without large increases in cost.

Fifth Embodiment

Next is a detailed description of a driving process for a liquid crystal display according to a fifth embodiment of the present invention. In the fourth embodiment of the present invention described in FIG. 11 and FIG. 12, the situation was described for the case where half of the display region was set as a black screen region, but in the fifth embodiment, the black screen region is set at ¼ or ¾ of the display region.

Figure 15:
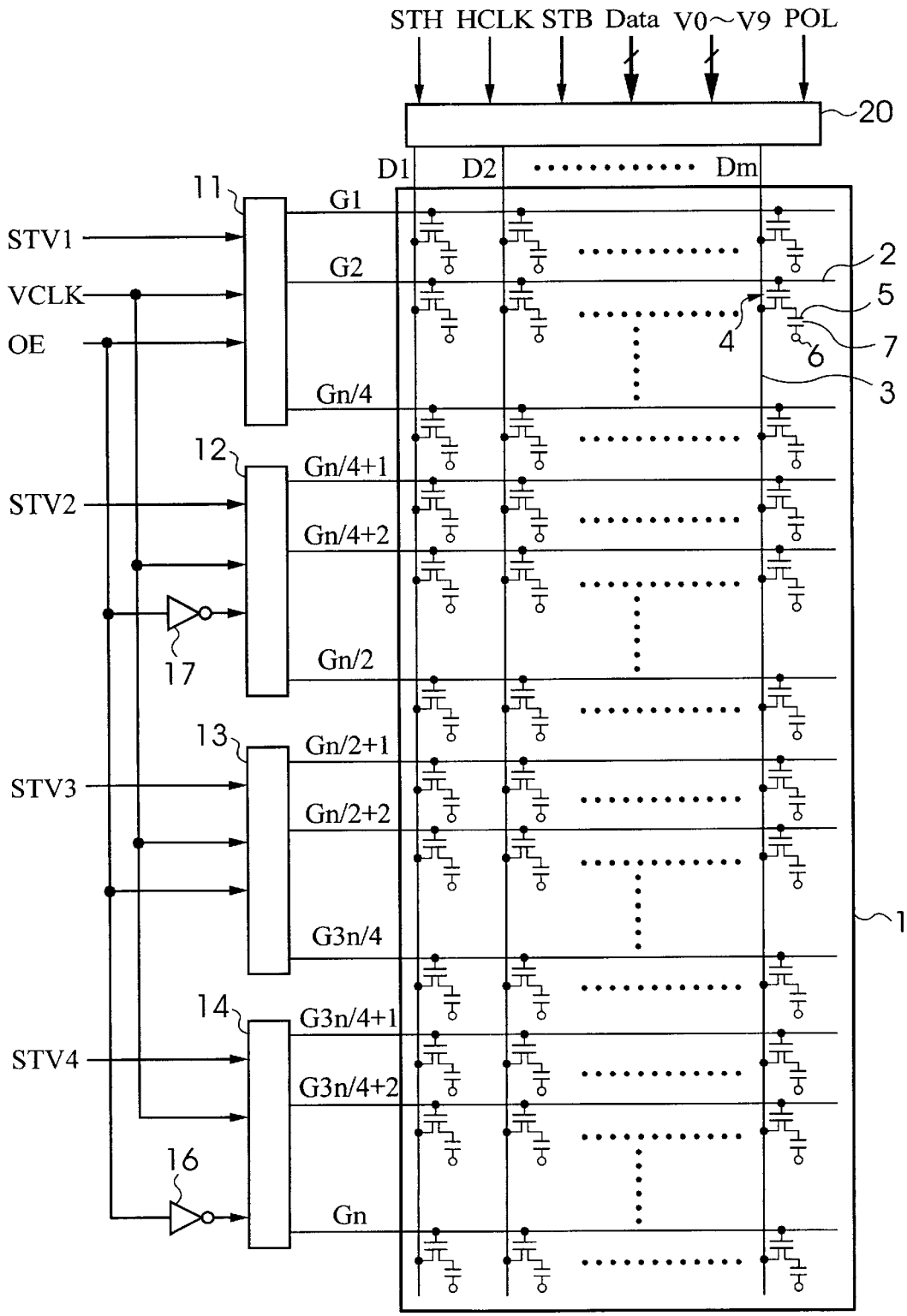
FIG. 15 is a diagram showing the construction of a liquid crystal display applicable to a liquid crystal display driving process according to a fifth embodiment of the present invention.

FIG. 15 is a diagram showing the construction of a liquid crystal display applicable to a liquid crystal display driving process according to the fifth embodiment of the present invention. The differences between the liquid crystal display applicable to the liquid crystal display driving process according to the fifth embodiment of the present invention shown in FIG. 15, and the liquid crystal display applicable to the liquid crystal display driving process according to the fourth embodiment of the present invention shown in FIG. 11, are that in FIG. 11 the inverter circuits 15 and 16 were provided which supplied the output control signal OE- to the row scanning line driving circuit 13 and the scanning line driving circuit 14, whereas in this fifth embodiment, the output control signal OE is supplied to the scanning line driving circuit 13 without the inverter circuit 15, and moreover another inverter circuit 17 is provided which supplies the output control signal OE- to the scanning line driving circuit 12.

Figure 16:
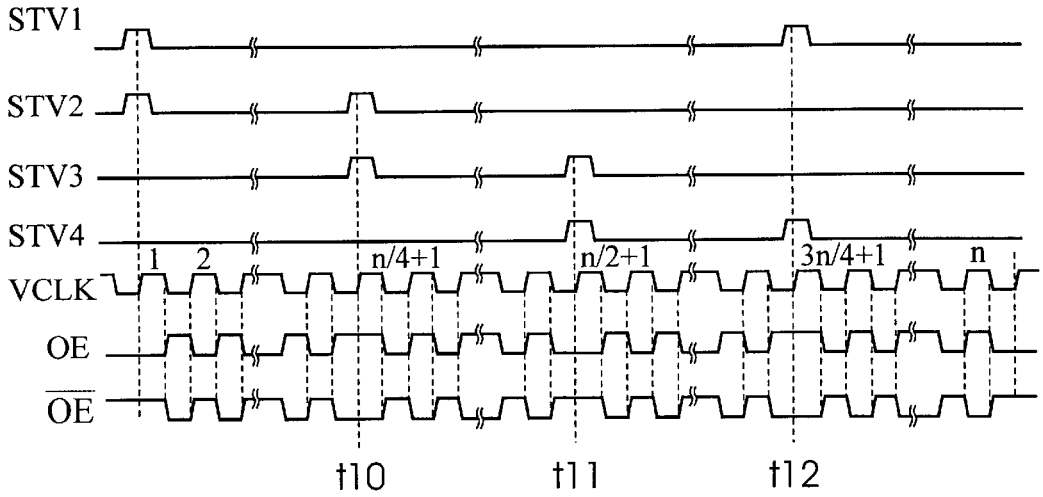
FIG. 16 is a timing chart of signals transmitted to each section in a case where ¼ of a display region is set as a black screen region.
Figure 17:
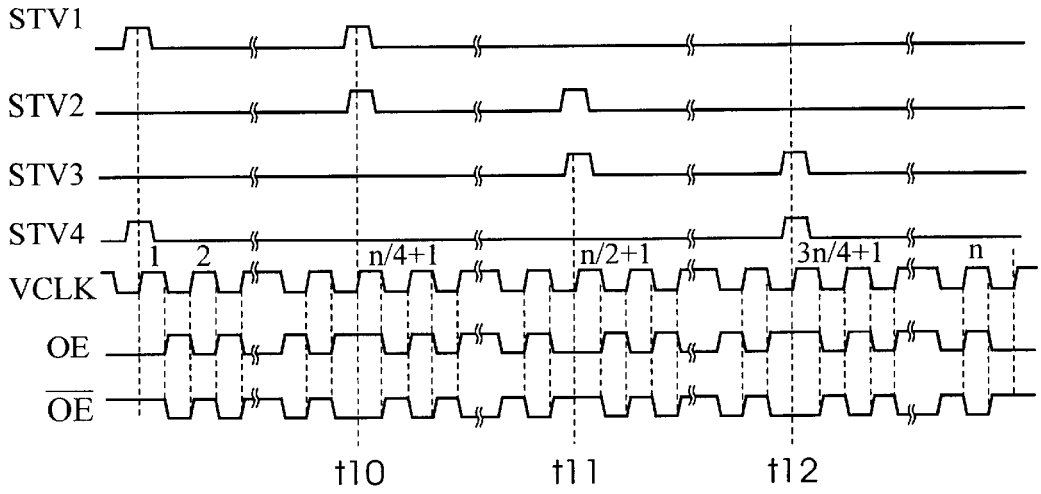
FIG. 17 is a timing chart of signals transmitted to each section in a case where ¾ of a display region is set as a black screen region.

In this fifth embodiment, using a liquid crystal display of the construction shown in FIG. 15, then by altering the driving process either ¼ or ¾ of the display region is set as a black screen region. FIG. 16 is a timing chart of signals transmitted to each section in the case where ¼ of the display region is set as the black screen region, and FIG. 17 is a timing chart of signals transmitted to each section in the case where ¾ of the display region is set as the black screen region. As is evident from reference to FIG. 16 and FIG. 17, the black screen region is set to either ¼ or ¾ of the display region by altering the combination of the output control signal OE and the output control signal OE- input into the scanning line driving circuits 11 to 14, and the corresponding input timings thereof. Moreover, in FIG. 16 and FIG. 17, the phases of the output control signal OE and the output control signal OE- are inverted at times labeled t11, t12 and t13.

Other Embodiments

Figure 18:
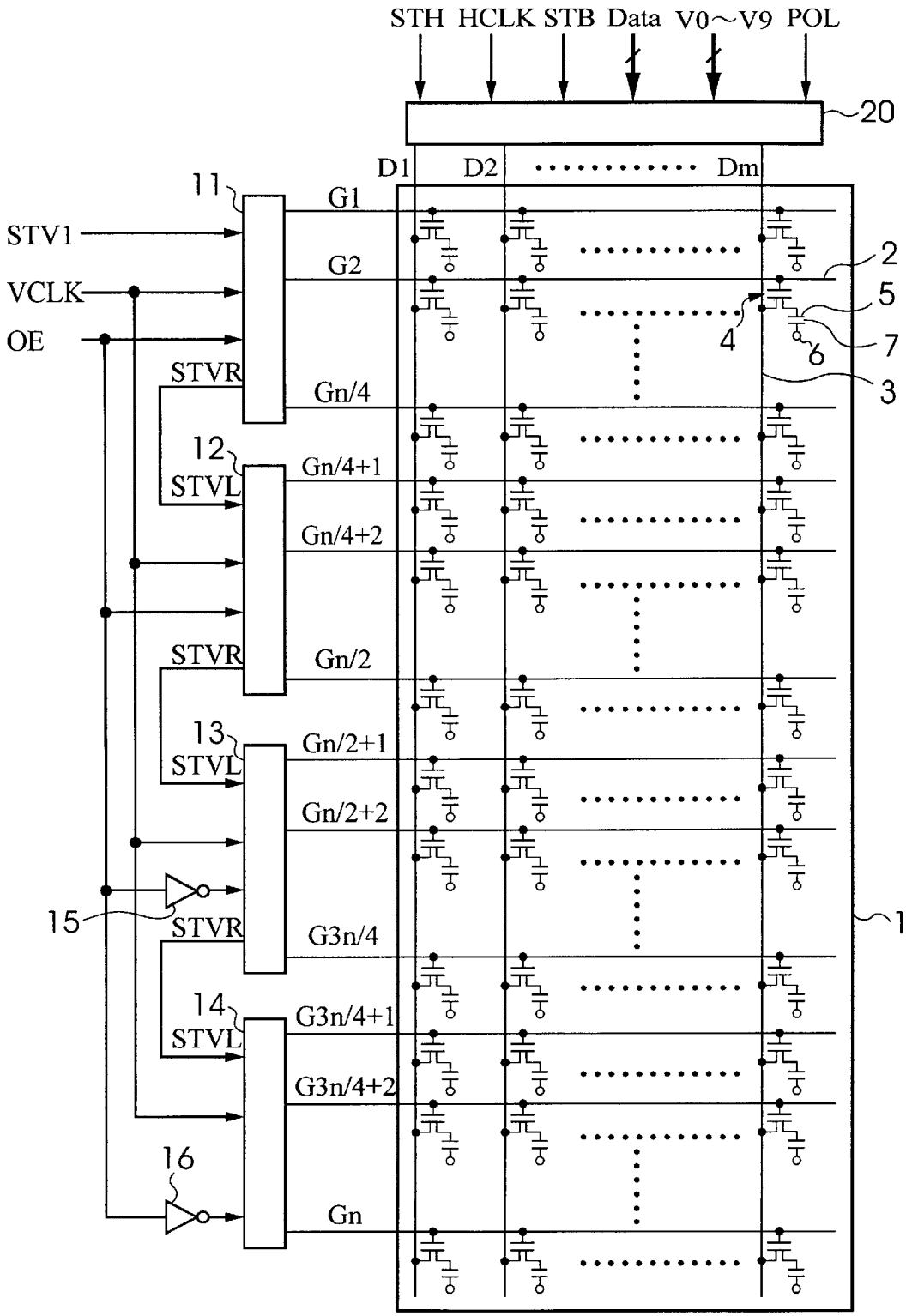
FIG. 18 is a diagram showing the construction of a liquid crystal display applicable to a liquid crystal display driving process according to another embodiment of the present invention.
Figure 19:
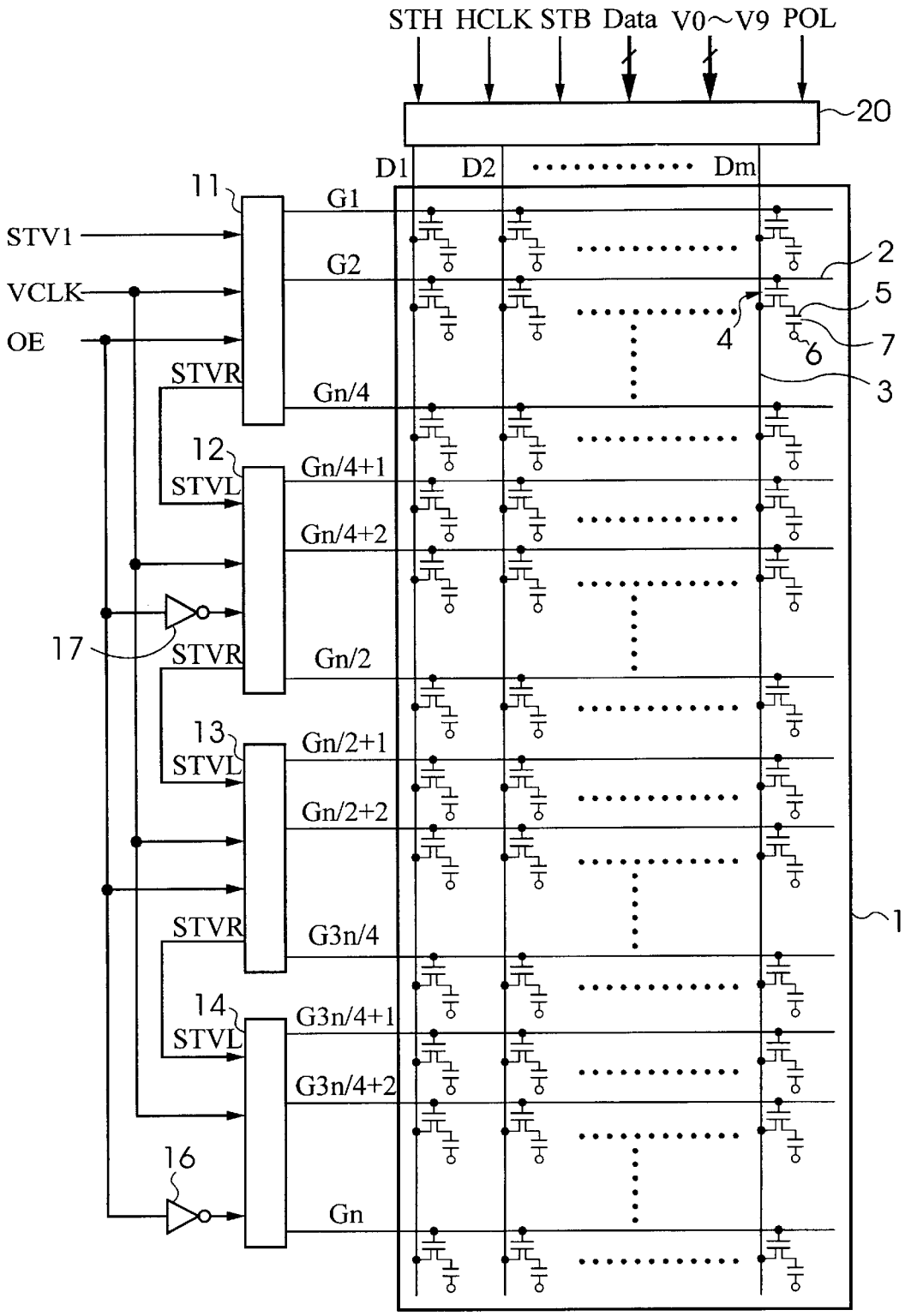
FIG. 19 is a diagram showing the construction of a liquid crystal display applicable to a liquid crystal display driving process according to another embodiment of the present invention.

The first through fifth embodiments of the present invention are described above, but the present invention may also be applied to cases where the scanning line driving circuit 11, the scanning line driving circuit 12, the scanning line driving circuit 13 and the scanning line driving circuit 14 are connected in tandem, such as the cases shown in FIG. 18 and FIG. 19. FIG. 18 and FIG. 19 are diagrams showing the construction of a liquid crystal display applicable to a liquid crystal display driving process according to other embodiments of the present invention.

In such cases, the scanning start pulse STVL corresponds with the black screen region, and the scanning start pulse STV1 shown in FIG. 12, FIG. 16 and FIG. 17 is input, and by then inputting the shift start pulse STVR output from the previous stage of the tandem connected scanning line driving circuits as the scanning start pulse STVL of the next stage scanning line driving circuit, these scanning start pulses STVL function as the scanning start pulses STV2, STV3 and STV4 shown in FIG. 12, FIG. 16 and FIG. 17, enabling driving to be performed in the same manner.

As described above, according to the other embodiments of the present invention, the proportion occupied by the black display region can be determined for each of the scanning line driving circuits 11 to 14. Furthermore, according to the embodiments of the present invention, by simply modifying the control signals input into the scanning line driving circuits 11 to 14 and the signal line driving circuit 20, the present invention can be constructed without any alterations being required to the conventional constructions of the liquid crystal display panel section 1, the signal line driving circuit 20 and the scanning line driving circuits 11 to 14, and consequently motion blur during the display of motion pictures can be improved without large increases in cost.

What is claimed is:

1. A driving process for a liquid crystal display in which a plurality of scanning lines and a plurality of signal lines are disposed in a grid arrangement, and display of an image corresponding with image data is performed by selecting any one of said scanning lines at one time, and altering a state of a liquid crystal via a signal line, the driving process comprising:

setting a first scanning period and a second scanning period within a time frame for scanning any one of said scanning lines;

displaying an image corresponding with said image data via said signal line during said first scanning period of said time frame on a first of said scanning lines;

displaying a monochromatic image via said signal line during said second scanning period on a second of said scanning lines within said time frame, wherein said first and second scanning lines are separated by a predetermined number of scanning lines; and applying a varying voltage to a common electrode to allow the voltage of said signal line to be reduced, wherein the varying voltage is applied to the common electrode for one scanning period for displaying image data and another period for displaying a black image.

2. The driving process of claim 1, wherein said monochromatic image is sequentially displayed across a predetermined number of consecutive scanning lines.

3. The driving process of claim 1, wherein signals relating to an image corresponding with said image data and a monochromatic image are output alternately to said signal line, and said signal relating to an image corresponding with said image data is output with an inversion in polarity at every said first scanning period, and a signal relating to said monochromatic image is output with an inversion in polarity at every said second scanning period.

4. The driving process of claim 1, wherein said monochromatic image comprises a black image.

5. The driving process of claim 4, wherein said liquid crystal is constructed so that a display state thereof is white when no voltage is applied thereto and gradually alters to a black display state in accordance with an applied voltage, said liquid crystal is positioned between said pixel electrode and said common electrode, and a voltage applied between said pixel electrode and said common electrode when displaying a black image during said second scanning period is greater than a voltage applied between said pixel electrode and said common electrode when producing a display during said first scanning period.

6. The driving process of claim 5, further comprising increasing a voltage applied to said pixel electrode via said signal line.

7. The driving process of to claim 5, further comprising applying a voltage to said pixel electrode via said signal line.

8. The driving process of claim 1, wherein said scanning lines are connected to a plurality of scanning line driving circuits, wherein two of said plurality of scanning line driving circuits are selected for scanning, wherein one of said two scanning line driving circuits scans scanning lines, which are connected to said one scanning line driving circuit during said first scanning period, and wherein the other of said two scanning line driving circuits scans scanning lines which are connected to said other scanning line driving circuit during said second scanning period.

9. The process of claim 1, wherein said scanning lines are connected to at least four scanning line driving circuits, wherein scanning lines are scanned in sequence by two of said four scanning line driving circuits during one of said first and second scanning periods and by the other two of said four scanning line driving circuits during the other of said first and second scanning periods.

10. The process of claim 1, wherein the monochromatic image comprises a black image that is displayed for a short period of time.

11. The process of claim 1, wherein the liquid crystal display is driven by a low voltage.

12. The process of claim 1, wherein the liquid crystal display rapidly displays the monochromatic image.

13. The process of claim 1, wherein the varying voltage is applied during at least one of said first scanning period and said second scanning period.

14. The process of claim 1, wherein said monochromatic image is processed during the period of time said monochromatic image display is selected without increasing the range of the voltage to said signal line.

15. The process of claim 1, wherein said displaying of said monochromatic image is completed even when a monochromatic image portion of said display is reduced.

16. A driving process for a liquid crystal display in which a plurality of scanning lines and a plurality of signal lines are disposed in a grid arrangement, and display of an image corresponding with image data is performed by selecting any one of said scanning lines at one time, and altering a state of a liquid crystal via a signal line, the driving process comprising:

setting a first scanning period and a second scanning period within a time frame for scanning any one of said scanning lines;

displaying an image corresponding with said image data via said signal line during said first scanning period; and displaying a monochromatic image via said signal line during said second scanning period, wherein said first scanning period and said second scanning period are separated by a predetermined time on at least one of said plurality of scanning lines, wherein said displaying said image and displaying said monochromatic image comprise applying a varying voltage to a common electrode to allow the voltage of said signal line to be reduced, wherein the varying voltage is applied to the common electrode for one scanning period for displaying image data and another period for displaying a black image.

17. The process of claim 16, wherein said monochromatic image is sequentially displayed across a predetermined number of consecutive scanning lines.

18. The process of claim 16, wherein signals relating to an image corresponding with said image data and a monochromatic image are output alternately to said signal line, and said signal relating to an image corresponding with said image data is output with an inversion in polarity between each said first scanning period, and a signal relating to said monochromatic image is output with an inversion in polarity between each said second scanning period.

19. The process of claim 16, wherein said monochromatic image comprises a black image.

20. The process of claim 19, wherein said liquid crystal is constructed so that a display state thereof is white when no voltage is applied and gradually alters to a black display state in accordance with an applied voltage, said liquid crystal being positioned between a pixel electrode and a common electrode, and a voltage applied between said pixel electrode and said common electrode when displaying a black image during said second scanning period is greater than a voltage applied between said pixel electrode and said common electrode when producing a black display during said first scanning period.

21. The process of claim 20, wherein a voltage applied between said pixel electrode and said common electrode is made variable by applying a varying voltage to said pixel electrode via said signal line.

22. A driving process for a liquid crystal display in which a plurality of scanning lines and a plurality of signal lines are disposed in a grid arrangement, and display of an image corresponding with image data is performed by selecting any one of said scanning lines at one time, and altering a state of a liquid crystal via a signal line, the driving process comprising:

setting a first scanning period and a second scanning period within a time frame for scanning any one of said scanning lines;

displaying an image corresponding with said image data via said signal line during said first scanning period of said time frame on a first of said scanning lines;

displaying a monochromatic image via said signal line during said second scanning period on a second of said scanning lines within said time frame, wherein said first and second scanning lines are separated by a predetermined number of scanning lines; and applying a varying voltage to a common electrode, wherein the varying voltage is applied to the common electrode for one scanning period for displaying image data and another period for displaying a black image.

* * * * *